US010267299B2

(12) United States Patent
Ogawa et al.

(10) Patent No.: US 10,267,299 B2
(45) Date of Patent: Apr. 23, 2019

(54) DOUBLE-HEADED PISTON TYPE SWASH PLATE COMPRESSOR

(71) Applicant: KABUSHIKI KAISHA TOYOTA JIDOSHOKKI, Aichi-ken (JP)

(72) Inventors: Hiromichi Ogawa, Kariya (JP); Shinya Yamamoto, Kariya (JP); Hiroyuki Nakaima, Kariya (JP); Takahiro Suzuki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 293 days.

(21) Appl. No.: 15/442,268

(22) Filed: Feb. 24, 2017

(65) Prior Publication Data

US 2017/0284382 A1 Oct. 5, 2017

(30) Foreign Application Priority Data

Mar. 30, 2016 (JP) ..... 2016-068653

(51) Int. Cl.
*F04B 53/14* (2006.01)
*F04B 27/08* (2006.01)
(Continued)

(52) U.S. Cl.
CPC ..... *F04B 27/0882* (2013.01); *F04B 27/005* (2013.01); *F04B 27/0878* (2013.01);
(Continued)

(58) Field of Classification Search
CPC ..... F04B 27/0882; F04B 39/0005; F04B 27/1036; F04B 27/0878; F04B 53/14;
(Continued)

(56) References Cited

U.S. PATENT DOCUMENTS 6,126,408 A * 10/2000 Murakami ..... F04B 27/12 417/269
6,453,554 B1 9/2002 Fukushima et al.
(Continued)

FOREIGN PATENT DOCUMENTS

CN 101598121 12/2009
EP 1 039 128 9/2000
(Continued)

OTHER PUBLICATIONS

U.S. Appl. No. 15/442,064 to Hiromichi Ogawa et al., filed Feb. 24, 2017.
(Continued)

*Primary Examiner* — Peter J Bertheaud
*Assistant Examiner* — Dnyanesh G Kasture
(74) *Attorney, Agent, or Firm* — Greenblum & Bernstein, P.L.C.

(57) ABSTRACT

A double-headed piston type swash plate compressor includes a rotation shaft, a housing, a swash plate, two cylinder bores, a double-headed piston, and two shoes. The double-headed piston includes two shoe holders, a neck, two heads, and two coupling portions. Each of the coupling portions includes an outer portion and an inner portion. A direction orthogonal to both of an opposing direction of the inner portion and the outer portion and the axial direction of the double-headed piston is referred to as a widthwise direction. The neck is larger in the widthwise direction than in the opposing direction so that the neck is deformable in the opposing direction. Each of the two coupling portions has a width that is less than or equal to a width of the neck. The inner portion includes a narrow portion. The narrow portion is at least partially located closer to the head than the shoe holder in the inner portion. The two coupling portions are deformable in the widthwise direction when the swash plate applies load to the double-headed piston.

8 Claims, 9 Drawing Sheets

(51) Int. Cl.

| | |
|---|---|
| ***F04B 27/00*** | (2006.01) |
| ***F04B 27/10*** | (2006.01) |
| ***F04B 27/18*** | (2006.01) |
| ***F04B 39/00*** | (2006.01) |

(52) U.S. Cl.
CPC ..... *F04B 27/0886* (2013.01); *F04B 27/1036* (2013.01); *F04B 27/1045* (2013.01); *F04B 27/1054* (2013.01); *F04B 27/18* (2013.01); *F04B 39/0005* (2013.01); *F04B 53/14* (2013.01)

(58) Field of Classification Search
CPC ..... F04B 27/005; F04B 27/1054; F04B 27/1045; F04B 27/0886; F04B 27/18; F01B 3/0085; F16J 1/001
See application file for complete search history.

(56) References Cited

U.S. PATENT DOCUMENTS

| | | | | |
|---|---|---|---|---|
| 6,484,621 | B1 * | 11/2002 | Kato | F04B 27/0878 92/172 |
| 9,429,147 | B2 | 8/2016 | Suzuki et al. | |
| 2003/0177900 | A1 | 9/2003 | Shiina | |
| 2008/0008606 | A1 * | 1/2008 | Muth | F04B 35/045 417/398 |
| 2015/0167655 | A1 | 6/2015 | Yamamoto et al. | |

FOREIGN PATENT DOCUMENTS

| | | |
|---|---|---|
| JP | 7-189900 | 7/1995 |
| JP | 2807068 | 9/1998 |
| JP | 2000-274350 | 10/2000 |
| JP | 2001-065452 | 3/2001 |
| JP | 2004003457 | 1/2004 |
| JP | 2015-161173 | 9/2015 |
| KR | 19990010734 | 3/1999 |
| KR | 100379980 | 3/2001 |
| KR | 20150070023 | 6/2015 |

OTHER PUBLICATIONS

U.S. Appl. No. 15/442,166 to Hiromichi Ogawa et al., filed Feb. 24, 2017.
Chinese Office Action issued in Chinese Patent Appl. No. 201710099670.7, dated Jul. 4, 2018.
Korean Office Action issued in counterpart Patent Appl. No. 10-2017-0022314, dated Feb. 12, 2018.

* cited by examiner

DOUBLE-HEADED PISTON TYPE SWASH PLATE COMPRESSOR

BACKGROUND OF THE INVENTION

The present invention relates to a double-headed piston type swash plate compressor.

One example of a compressor is a double-headed piston type swash plate compressor including a swash plate that rotates when a rotation shaft rotates and a double-headed piston that reciprocates in a pair of cylinder bores when the swash plate rotates. The double-headed piston compresses fluid in compression chambers that are defined in the two cylinder bores when the double-headed piston reciprocates (refer to Japanese Laid-Open Patent Publication No. 2015-161173).

In the structure of the above double-headed piston type swash plate compressor, there may be a difference between a coaxiality in each of the two cylinder bores and a coaxiality in the double-headed piston. This causes the double-headed piston to reciprocate with the axis of the double-headed piston misaligned from the axis of the two cylinder bores. In such a case, the double-headed piston and the two cylinder bores may be jammed.

To prevent jamming between the double-headed piston and the two cylinder bores, a sufficient gap may be formed between the head of the double-headed piston and the wall surfaces of the cylinder bores. However, when the gap is widened, fluid easily leaks from the compression chambers and increases loss.

In particular, in the double-headed piston type swash plate compressor that includes a pair of cylinder bores, coaxialities in the two cylinder bores may differ from each other. As a result, jamming easily occurs in the double-headed piston arranged in both of the cylinder bores.

SUMMARY OF THE INVENTION

It is an object of the present invention to provide a double-headed piston type swash plate compressor that limits jamming between a double-headed piston and two cylinder bores.

To achieve the above object, a double-headed piston type swash plate compressor according to one aspect of the present invention includes a rotation shaft, a housing, a swash plate, two cylinder bores, a double-headed piston, and two shoes. The rotation shaft extends in an axial direction and a radial direction. The housing accommodates the rotation shaft. The swash plate rotates when the rotation shaft rotates. The two cylinder bores are opposed to each other in the axial direction of the rotation shaft and located in the housing at an outer side of the rotation shaft in the radial direction. The double-headed piston reciprocates in the two cylinder bores. The two shoes couple the double-headed piston to the swash plate. The two cylinder bores and the double-headed piston define two compression chambers. Rotation of the swash plate reciprocates the double-headed piston in the two cylinder bores and compresses fluid in each of the compression chambers. The double-headed piston includes two shoe holders, a neck, two heads, and two coupling portions. The two shoe holders hold the two shoes. The two shoe holders are opposed to each other in an axial direction of the double-headed piston. The neck couples the two shoe holders. The neck is located at an outer circumferential side of the swash plate. The two heads are respectively located at two ends of the double-headed piston in the axial direction of the double-headed piston. The two heads are respectively located in the two cylinder bores with a gap formed between each of the two heads and a wall surface of the corresponding one of the two cylinder bores. The two coupling portions couple the two shoe holders and the two heads, respectively. Each of the coupling portions includes an outer portion extending in the axial direction of the double-headed piston and an inner portion located at an inner side of the outer portion in the radial direction. The inner portion is extended in the axial direction of the double-headed piston and opposed to the outer portion in the radial direction. A direction orthogonal to both of an opposing direction of the inner portion and the outer portion and the axial direction of the double-headed piston is referred to as a widthwise direction. The neck is larger in the widthwise direction than in the opposing direction so that the neck is deformable in the opposing direction when the swash plate applies load to the double-headed piston. Each of the two coupling portions has a width that is less than or equal to a width of the neck. The inner portion includes a narrow portion having a width that is less than or equal to a width of each of the shoe holders. The narrow portion is at least partially located closer to the head than the shoe holder in the inner portion. The two coupling portions are deformable in the widthwise direction when the swash plate applies load to the double-headed piston.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to FIGS. 1 to 9. The double-headed piston type swash plate compressor of the present embodiment is installed in a vehicle for use with a vehicle air conditioner. That is, fluid that is subject to compression by the double-headed piston type swash plate compressor of the present embodiment is refrigerant. In FIGS. 1 and 5 to 9, the double-headed piston 100 is shown in a side view or a plan view.

Figure 1:
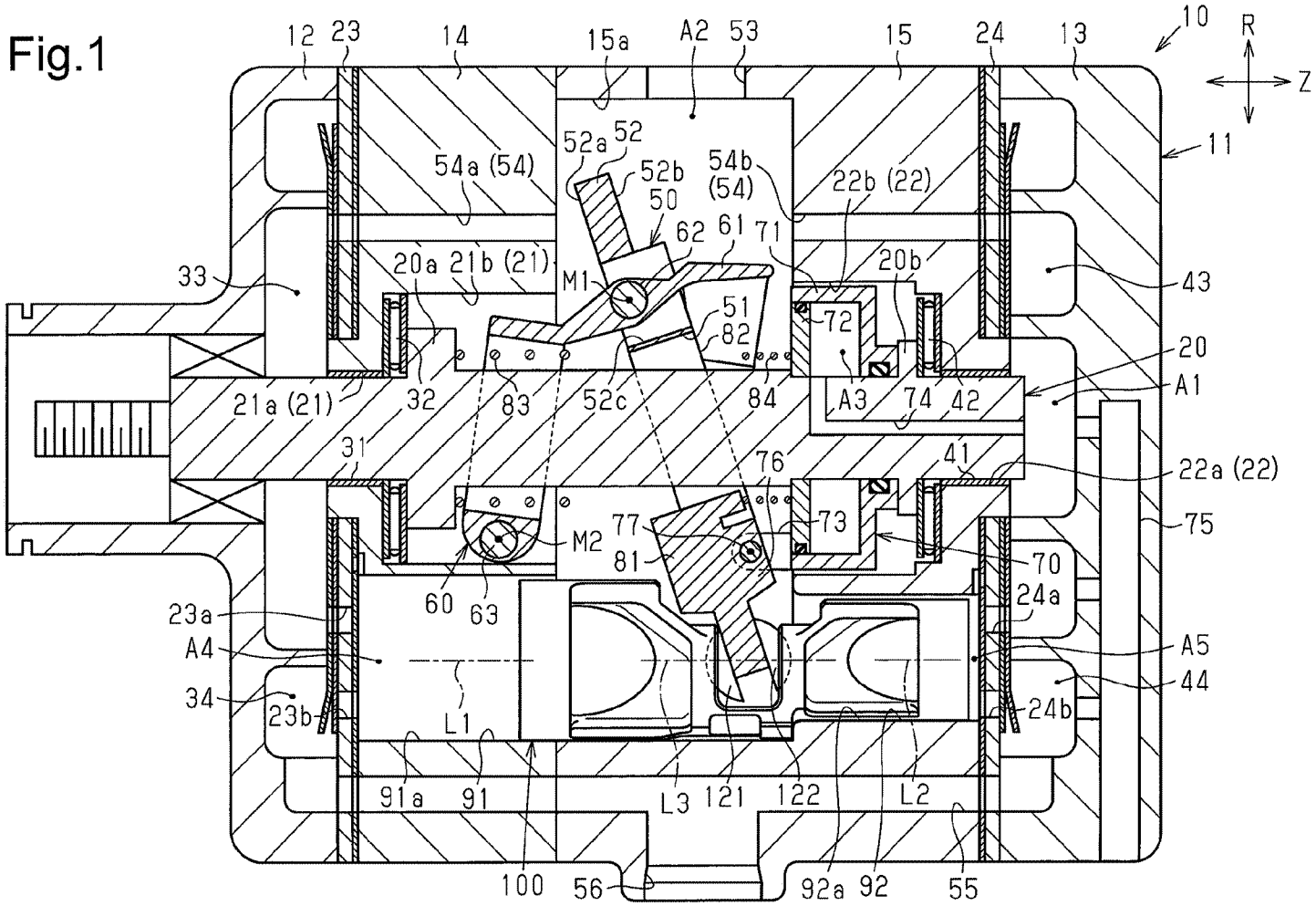
FIG. 1 is a cross-sectional view schematically showing a double-headed piston type swash plate compressor.

As shown in FIG. 1, a double-headed piston type swash plate compressor 10 (hereinafter referred to as compressor 10) includes a housing 11 that forms the shell of the compressor 10. The entire housing 11 is tubular.

The housing 11 rotationally accommodates a rotation shaft 20. The rotation shaft 20 is located near the center in the housing 11. The axial direction Z of the rotation shaft 20 corresponds to the axial direction of the housing 11. In the following description, the axial direction Z of the rotation shaft 20 is referred to as the axial direction Z.

The housing 11 includes a tubular front housing 12, which forms one end of the housing 11 in the axial direction Z, a tubular rear housing 13, which has a bottom and forms the other end of the housing 11 in the axial direction Z, and two cylinder blocks 14 and 15 (first cylinder block 14 and second cylinder block 15), which are arranged between the front housing 12 and the rear housing 13. The cylinder blocks 14 and 15 are cylindrical and respectively include first and second shaft holes 21 and 22 through which the rotation shaft 20 can be inserted.

The first cylinder block 14 includes the first shaft hole 21 that extends through the first cylinder block 14 in the axial direction Z. The first shaft hole 21 includes a first small diameter hole 21*a*, which has a slightly larger diameter than the rotation shaft 20, and a first large diameter hole 21*b*, which is larger than the first small diameter hole 21*a*. The first small diameter hole 21*a* is located closer to the front housing 12 than the first large diameter hole 21*b*.

The second cylinder block 15 includes the second shaft hole 22 that extends through the second cylinder block 15 in the axial direction Z. The second shaft hole 22 includes a second small diameter hole 22*a*, which has a slightly larger diameter than the rotation shaft 20, and a second large diameter hole 22*b*, which is larger than the second small diameter hole 22*a*. The second small diameter hole 22*a* is located closer to the rear housing 13 than the second large diameter hole 22*b*. The two cylinder blocks 14 and 15 are coupled to each other with the two shaft holes 21 and 22 (more specifically, two large diameter holes 21*b* and 22*b*) opposing each other in the axial direction Z.

A first valve/port body 23 is arranged between the front housing 12 and the first cylinder block 14. A second valve/port body 24 is arranged between the rear housing 13 and the second cylinder block 15. The valve/port bodies 23 and 24 each have the form of a flat ring. The valve/port bodies 23 and 24 have a larger inner diameter than the rotation shaft 20.

The rotation shaft 20 is inserted through the two shaft holes 21 and 22 and the two valve/port bodies 23 and 24 and extended from the front housing 12 to the rear housing 13. In this case, one end of the rotation shaft 20 in the axial direction Z is located in the front housing 12, and the other end of the rotation shaft 20 in the axial direction Z is located in a regulation chamber A1, which is defined by the rear housing 13 and the second cylinder block 15. That is, the rotation shaft 20 extends through the two cylinder blocks 14 and 15. The regulation chamber A1 will be described later.

As shown in FIG. 1, a first radial bearing 31 that rotationally supports the rotation shaft 20 is arranged between the rotation shaft 20 and a wall surface of the first small diameter hole 21*a*. In the same manner, a second radial bearing 41 that rotationally supports the rotation shaft 20 is arranged between the rotation shaft 20 and a wall surface of the second small diameter hole 22*a*. The rotation shaft 20 is supported by the two radial bearings 31 and 41 in the housing 11 in a rotatable manner.

The rotation shaft 20 includes a first shaft projection 20*a* and a second shaft projection 20*b*. The first shaft projection 20*a* is located in the first large diameter hole 21*b* and projected in the radial direction R of the rotation shaft 20 (hereinafter referred to as the radial direction R), and the second shaft projection 20*b* is located in the second large diameter hole 22*b* and projected in the radial direction R. The first shaft projection 20*a* is opposed to a ring-shaped step surface in the axial direction X. The step surface connects the first small diameter hole 21*a* to the first large diameter hole 21*b*. A first thrust bearing 32 is arranged between the first shaft projection 20*a* and the step surface. The second shaft projection 20*b* is opposed to a ring-shaped step surface in the axial direction X. The step surface connects the second small diameter hole 22*a* to the second large diameter hole 22*b*. A second thrust bearing 42 is arranged between the second shaft projection 20*b* and the step surface.

The housing 11 includes two suction chambers 33 and 43 (first suction chamber 33 and second suction chamber 43) and two discharge chambers 34 and 44 (first discharge chamber 34 and second discharge chamber 44). Each of the first suction chamber 33 and the first discharge chamber 34 is defined by the front housing 12 and the first valve/port body 23. Each of the second suction chamber 43 and the second discharge chamber 44 is defined by the rear housing 13 and the second valve/port body 24. The two suction chambers 33 and 43 oppose each other in the axial direction Z, and the two discharge chambers 34 and 44 oppose each other in the axial direction Z. The suction chambers 33 and 43 and the discharge chambers 34 and 44 are formed to be annular as viewed in the axial direction Z, and the discharge chambers 34 and 44 are located at the outer sides of the suction chambers 33 and 43.

As shown in FIG. 1, the compressor 10 includes a swash plate 50 that rotates when the rotation shaft 20 rotates. The swash plate 50 is inclined with respect to a direction that is orthogonal to the axial direction Z of the rotation shaft 20.

The swash plate 50 includes a swash plate body 52, which has the form of a flat ring. The swash plate body 52 includes a swash plate insertion hole 51 through which the rotation shaft 20 is inserted. The swash plate body 52 includes a first inclined surface 52*a*, which is directed toward the first cylinder block 14, and a second inclined surface 52*b*, which is directed toward the side opposite to the first inclined surface 52*a*.

The swash plate 50 of the present embodiment is configured so that the inclination angle can be changed with respect to the direction orthogonal to the axial direction Z of the rotation shaft 20.

The housing 11 includes a swash plate chamber A2 that accommodates the swash plate 50. The swash plate chamber A2 is defined by the two cylinder blocks 14 and 15. The swash plate chamber A2 is located between the two shaft holes 21 and 22 and is in communication with the two shaft holes 21 and 22.

As shown in FIG. 1, a side wall of the second cylinder block 15 defining the swash plate chamber A2 includes a suction port 53. Thus, the suction port 53 is in communication with the swash plate chamber A2. Further, the housing 11 includes a suction passage 54 through which the swash plate chamber A2 is in communication with the suction chambers 33 and 43. The suction passage 54 includes a first suction passage 54*a* and a second suction passage 54*b*. The first suction passage 54*a* extends through the first cylinder block 14 and the first valve/port body 23 in the axial direction Z and communicates the swash plate chamber A2 and the first suction chamber 33. The second suction passage 54*b* extends through the second cylinder block 15 and the second valve/port body 24 in the axial direction Z and communicates the swash plate chamber A2 and the second suction chamber 43. A plurality of the suction passages 54*a* and 54*b* extend in the circumferential direction around the shaft holes 21 and 22 in the cylinder blocks 14 and 15.

In such a structure, fluid that is drawn from the suction port 53 flows through the swash plate chamber A2 and the suction passage 54 into the suction chambers 33 and 43. In this case, the swash plate chamber A2 and the two large diameter holes 21*b* and 22*b* that are in communication with the swash plate chamber A2 have the same pressure as the fluid drawn from the suction port 53.

The housing 11 includes a discharge passage 55 that is in communication with the two discharge chambers 34 and 44. The discharge passage 55 is located at the outer side of the swash plate chamber A2 and cylinder bores 91 and 92 (first and second cylinder bores 91 and 92, described below) in the radial direction R. The discharge passage 55 is in communication with a discharge port 56, which is located in the housing 11 (more specifically, side wall of second cylinder block 15). Fluid in the two discharge chambers 34 and 44 is discharged out of the discharge port 56 through the discharge passage 55.

As shown in FIG. 1, the compressor 10 includes a link mechanism 60 that allows the inclination angle of the swash plate 50 to change and links the swash plate 50 to the rotation shaft 20 so that the swash plate 50 and the rotation shaft 20 integrally rotate. The link mechanism 60 is located closer to the front housing 12 than the swash plate 50 except for part of the link mechanism 60.

The link mechanism 60 includes a lug arm 61, a first link pin 62, and a second link pin 63. The lug arm 61 extends from the first large diameter hole 21*b* to the swash plate chamber A2. The first link pin 62 pivotally couples the lug arm 61 to the swash plate 50. The second link pin 63 pivotally couples the lug arm 61 to the rotation shaft 20.

The lug arm 61 is L-shaped and includes a basal portion opposing the front housing 12 and a distal portion opposing the swash plate 50. The distal portion of the lug arm 61 projects out of the swash plate 50 toward the rear housing 13 through an arm through hole 52*c* in the swash plate body 52 of the swash plate 50. The projecting portion includes a weight.

The arm through hole 52*c*, for example, does not have an annular shape extending over the entire circumference of the swash plate 50 and is rectangular as viewed in the axial direction Z. The arm through hole 52*c* includes an inner surface including two opposing inner surfaces that are opposed to each other in the direction orthogonal to both of the thickness-wise direction of the swash plate 50 and the direction parallel to the axes of the swash plate insertion hole 51 and the arm through hole 52*c*.

The first link pin 62 is, for example, cylindrical. The first link pin 62 is located in the arm through hole 52*c* so that the axial direction of the first link pin 62 corresponds to the opposing direction of the two opposing inner surfaces. The first link pin 62 is extended through a portion of the lug arm 61 extending in the axial direction Z and attached to the swash plate 50. The portion of the lug arm 61 extending in the axial direction Z is supported by the swash plate 50 pivotally about the axis of the first link pin 62, which serves as the first pivot center M1.

The second link pin 63 is, for example, cylindrical. The second link pin 63 is arranged so that the axial direction of the second link pin 63 is parallel to the axial direction of the first link pin 62. The second link pin 63 is located in the basal portion of the lug arm 61 separated from where the lug arm 61 extends in the axial direction Z. The second link pin 63 is extended through the basal portion of the lug arm 61 and fixed to the rotation shaft 20. The basal portion of the lug arm 61 is pivotally supported by the rotation shaft 20 about the axis of the second link pin 63, which serves as the second pivot center M2.

As shown in FIG. 1, the compressor 10 includes an actuator 70 that changes the inclination angle of the swash plate 50. The actuator 70 is located closer to the rear housing 13 than the swash plate 50.

The actuator 70 includes a movable body 71 that is movable in the axial direction Z, and a partition 72 that defines a control chamber A3 in cooperation with the movable body 71, and two coupling pieces 73 that couple the movable body 71 to the swash plate 50. The compression chamber A3 is used to control the inclination angle of the swash plate 50.

The movable body 71 has the form of a tube (more specifically, cylindrical tube) and includes a bottom and a tubular portion. The movable body opens toward one side. The bottom of the movable body 71 includes an insertion hole through which the rotation shaft 20 can be inserted. The movable body 71 rotates integrally with the rotation shaft 20 with the rotation shaft 20 inserted through the insertion hole and the open end of the movable body 71 directed toward the swash plate chamber A2.

The partition 72 has the form of a flat ring and has an outer diameter that is set to be substantially the same as an inner diameter of the movable body 71. The partition 72, which is fitted onto the rotation shaft 20 and into the movable body 71, is fixed to the rotation shaft 20 so that the partition 72 rotates integrally with the rotation shaft 20. The partition 72 closes the open end of the movable body 71 that is close to the swash plate chamber A2. The control chamber A3 is defined by an inner circumferential surface of the movable body 71 and a surface of the partition 72 located at the side opposite to the swash plate chamber A2.

A portion between the inner circumferential surface of the movable body 71 and an outer circumferential surface of the partition 72 is sealed to restrict movement of fluid between the control chamber A3 and the swash plate chamber A2. This allows the control chamber A3, the swash plate chamber A2, and the second large diameter hole 22*b* to have different pressures. The position of the movable body 71 changes in accordance with the pressure difference of the control chamber A3 and the swash plate chamber A2.

The rotation shaft 20 includes a shaft passage 74 that communicates the regulation chamber A1 and the control chamber A3. The shaft passage 74 includes an axial portion, which opens in the regulation chamber A1 and extends in the axial direction Z, and a radial portion, which is in communication with the axial portion. The radial portion opens in the control chamber A3 and extends in the radial direction R. The shaft passage 74 allows fluid to move between the control chamber A3 and the regulation chamber A1. Thus, the control chamber A3 and the regulation chamber A1 have the same pressure.

The compressor 10 includes a pressure controller 75 that controls the pressure of the regulation chamber A1. The pressure controller 75 includes a low-pressure passage that communicates the second suction chamber 43 and the regulation chamber A1, a high-pressure passage that communicates the second discharge chamber 44 and the regulation chamber A1, a valve that is located on the low-pressure passage and regulates the amount of fluid discharged from the regulation chamber A1 into the second suction chamber 43, and an orifice that is located in the high-pressure passage and regulates the flow rate of the discharged fluid flowing in the high-pressure passage. The pressure controller 75 controls the pressure of the regulation chamber A1 by controlling the valve. This allows the position of the movable body 71 to be adjusted.

The two coupling pieces 73 project toward the swash plate 50 from part of the annular open end of the movable body 71 as viewed in the axial direction Z. More specifically, the two coupling pieces 73 project toward the swash plate 50 from a portion of the movable body 71 located toward the side opposite to the distal portion of the lug arm 61 from the rotation shaft 20 as viewed in the axial direction Z. The two coupling pieces 73 oppose each other in the pivot axes of the two pivot centers M1 and M2 (direction in which pivot centers M1 and M2 extend).

The swash plate 50 includes a plate-shaped coupling receiving portion 76 that projects from the second inclined surface 52*b* and overlaps the two coupling pieces 73 as viewed in the pivot axis. The coupling receiving portion 76 and the arm through hole 52*c* are located in the second inclined surface 52*b* at opposite sides of the swash plate insertion hole 51. The coupling receiving portion 76 includes a coupling hole through which a coupling pin 77 extending in the pivot axis can be inserted. The coupling pin 77 is located between the two coupling pieces 73. The coupling pin 77 is inserted through the coupling hole and fixed to the two coupling pieces 73. Thus, the swash plate 50 is coupled to the movable body 71. In this case, the movement of the movable body 71 changes the inclination angle of the swash plate 50. That is, adjustment of the position of the movable body 71 adjusts the inclination angle of the swash plate 50.

To simplify the drawings, the coupling pin 77 and the coupling hole have the same shape. However, the coupling hole actually has an oval shape elongated in the vertical direction and has a larger diameter than the coupling pin 77 so as to correspond to changes in the inclination angle of the swash plate 50.

As shown in FIG. 1, the swash plate 50 includes a first projection 81 that projects from the first inclined surface 52*a* and a second projection 82 that projects from the second inclined surface 52*b*. The second projection 82 is separate from the coupling receiving portion 76.

The first projection 81 does not extend over the entire circumference of the first inclined surface 52*a*. Rather, the first projection 81 extends over a portion of the first inclined surface 52*a* located at the opposite side of the arm through hole 52*c* with respect to the swash plate insertion hole 51. The second projection 82 extends in the circumferential direction around the swash plate insertion hole 51 in the second inclined surface 52*b*. The two projections 81 and 82 are located in the radial direction R at the inner side of a portion of the inclined surfaces 52*a* and 52*b* that is held by two shoes 121 and 122 (described later). Thus, the swash plate 50 includes a circumferential portion that is thinner than the portion where the two projections 81 and 82 and the coupling receiving portion 76 are arranged.

A recovery spring 83 is fixed to the first shaft projection 20*a* of the rotation shaft 20. The recovery spring 83 extends in the axial direction Z from the first shaft projection 20*a* toward the swash plate chamber A2. Further, an inclination reduction spring 84 is arranged between the partition 72 and the swash plate 50. The inclination reduction spring 84 includes one end fixed to the partition 72 and the other end fixed to the swash plate 50. The inclination reduction spring 84 biases the swash plate 50 in a direction that decreases the inclination angle of the swash plate 50.

The compressor 10 includes pairs of cylinder bores 91 and 92. The cylinder bores 91 and 92 of each pair are opposed to each other in the axial direction Z and located at the outer side of the rotation shaft 20 in the radial direction R in the housing 11. The cylinder bores 91 and 92 are located at the outer side of the shaft holes 21 and 22 in the radial direction R. The pairs of the cylinder bores 91 and 92 extend in the circumferential direction around the shaft holes 21 and 22 of the cylinder blocks 14 and 15. The cylinder bores 91 are opposed to the cylinder bores 92 at opposite sides of the swash plate chamber A2. The cylinder bores 91 and 92 are opposed to each other so that the first cylinder bore axis L1, which is the axis of the first cylinder bore 91, corresponds to the second cylinder bore axis L2, which is the axis of the second cylinder bore 92. That is, the cylinder bores 91 and 92 are coaxial.

To facilitate understanding, FIG. 1 shows only one of the cylinder bores 91 and one of the cylinder bores 92. Further, the cylinder bores 91 and 92 are separated from the suction passages 54*a* and 54*b* in the circumferential direction so that the cylinder bores 91 and 92 do not interfere with the suction passages 54*a* and 54*b* around the shaft holes 21 and 22.

The cylinder bores 91 and 92 have the form of a tube (more specifically, cylindrical tube) and extend through the corresponding cylinder blocks 14 and 15 in the axial direction Z. One opening of each of the cylinder bores 91 and 92 is in communication with the swash plate chamber A2, and the other opening of each of the cylinder bores 91 and 92 is closed by the valve/port body 23 or 24. The first valve/port body 23 partitions each first cylinder bore 91 from the first suction chamber 33 and the first discharge chamber 34, and the second valve/port body 24 partitions each second cylinder bore 92 from the second suction chamber 43 and the second discharge chamber 44.

As shown in FIG. 1, the valve/port bodies 23 and 24 close the openings of the cylinder bores 91 and 92 and include suction ports 23*a* and 24*a* that are respectively in communication with the suction chambers 33 and 43 and discharge ports 23*b* and 24*b*, which are respectively in communication with the discharge chambers 34 and 44 through the valve. The suction ports 23*a* and 24*a* and the discharge ports 23*b* and 24*b* extend in the circumferential direction in correspondence with the cylinder bores 91 and 92 that extend in the circumferential direction.

The compressor 10 includes the double-headed piston 100 that reciprocates in each pair of the cylinder bores 91 and 92 and the two shoes 121 and 122 that couple the double-headed piston 100 to the swash plate 50.

The double-headed piston 100 is accommodated in each pair of the cylinder bores 91 and 92 so that the axial direction of the double-headed piston 100 corresponds to the axial direction Z of the rotation shaft 20 (in other words, opposing direction of two cylinder bores 91 and 92). More specifically, the double-headed piston 100 is arranged in each pair of the cylinder bores 91 and 92 so that the piston axis L3, which is the axis of the double-headed piston 100, is coaxial with the two cylinder bore axes L1 and L2.

The double-headed pistons 100 extend in the circumferential direction in correspondence with the cylinder bores 91 and 92 extended in the circumferential direction. That is, each pair of the cylinder bores 91 and 92 includes one of the double-headed pistons 100.

The structures of the double-headed piston 100 and the like will now be described in detail.

As shown in FIGS. 2 to 5, the double-headed piston 100 includes a neck 101, shoe holders 102 and 112 that hold the two shoes 121 and 122, two heads 103 and 113 located at the two ends in the axial direction of the double-headed piston 100, and two coupling portions 104 and 114 that respectively couple the shoe holders 102 and 112 to the heads 103 and 113. The two shoe holders 102 and 112 oppose each other in the axial direction of the double-headed piston 100. The neck 101 couples the two shoe holders 102 and 112.

The coupling portions 104 and 114 include inner portions 105 and 115 and outer portions 106 and 116 extending in the axial direction of the double-headed piston 100. The inner portions 105 and 115 are respectively opposed to the outer portions 106 and 116 in the radial direction R. Further, the coupling portions 104 and 114 include plates 107 and 117 that couple the inner portions 105 and 115 to the outer portions 106 and 116, respectively. The inner portions 105 and 115 are located at the inner side of the outer portions 106 and 116 in the radial direction R (i.e., in portion of double-headed piston 100 that is close to rotation shaft 20).

The axial direction of the double-headed piston 100 is the direction in which the head 103 is opposed to the head 113, and the radial direction R is the direction in which the inner portions 105 and 115 are opposed to the outer portions 106 and 116. To facilitate understanding, a direction orthogonal to both of the axial direction of the double-headed piston 100 and the opposing direction of the inner portions 105 and 115 and the outer portions 106 and 116 is hereinafter referred to as the widthwise direction W.

Figure 2:
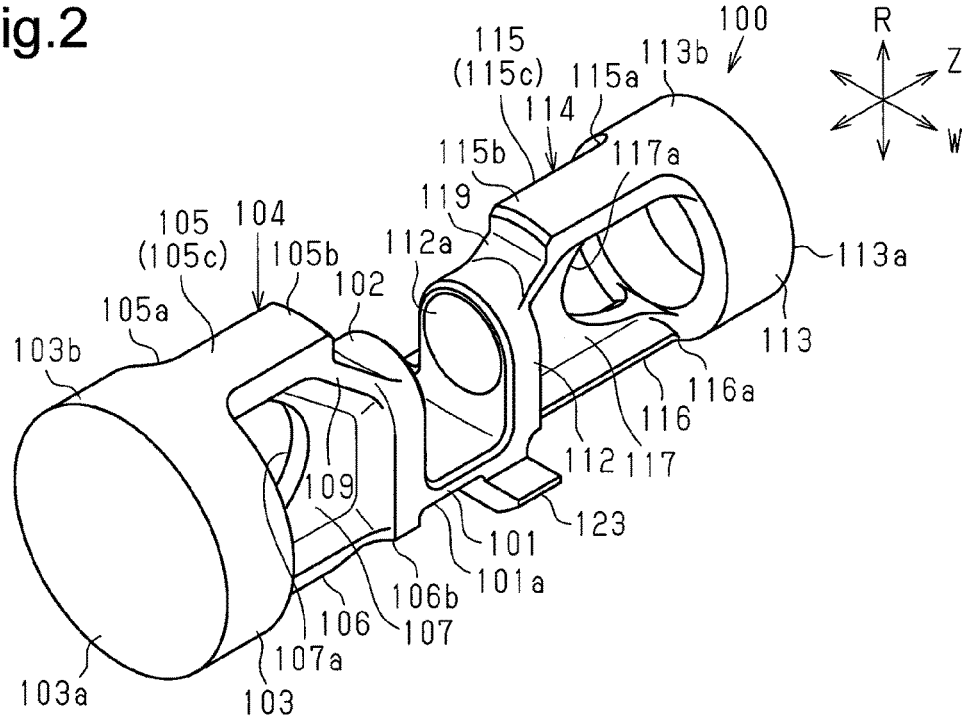
FIG. 2 is a perspective view of a double-headed piston shown in FIG. 1.
Figure 3:
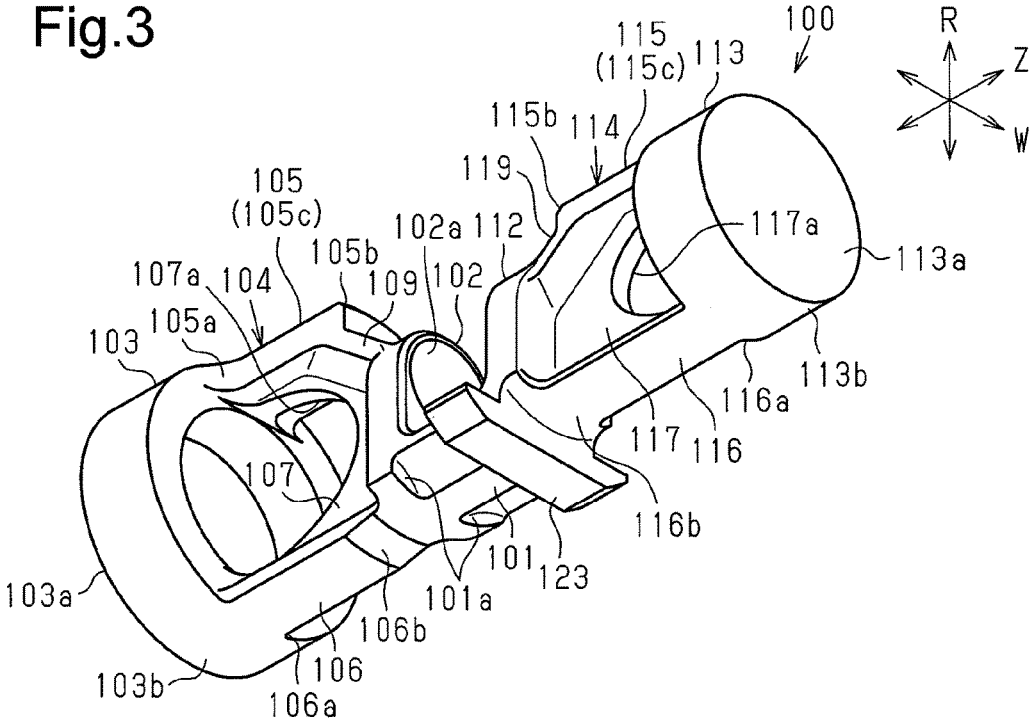
FIG. 3 is a perspective view of the double-headed piston shown in FIG. 1.
Figure 5:
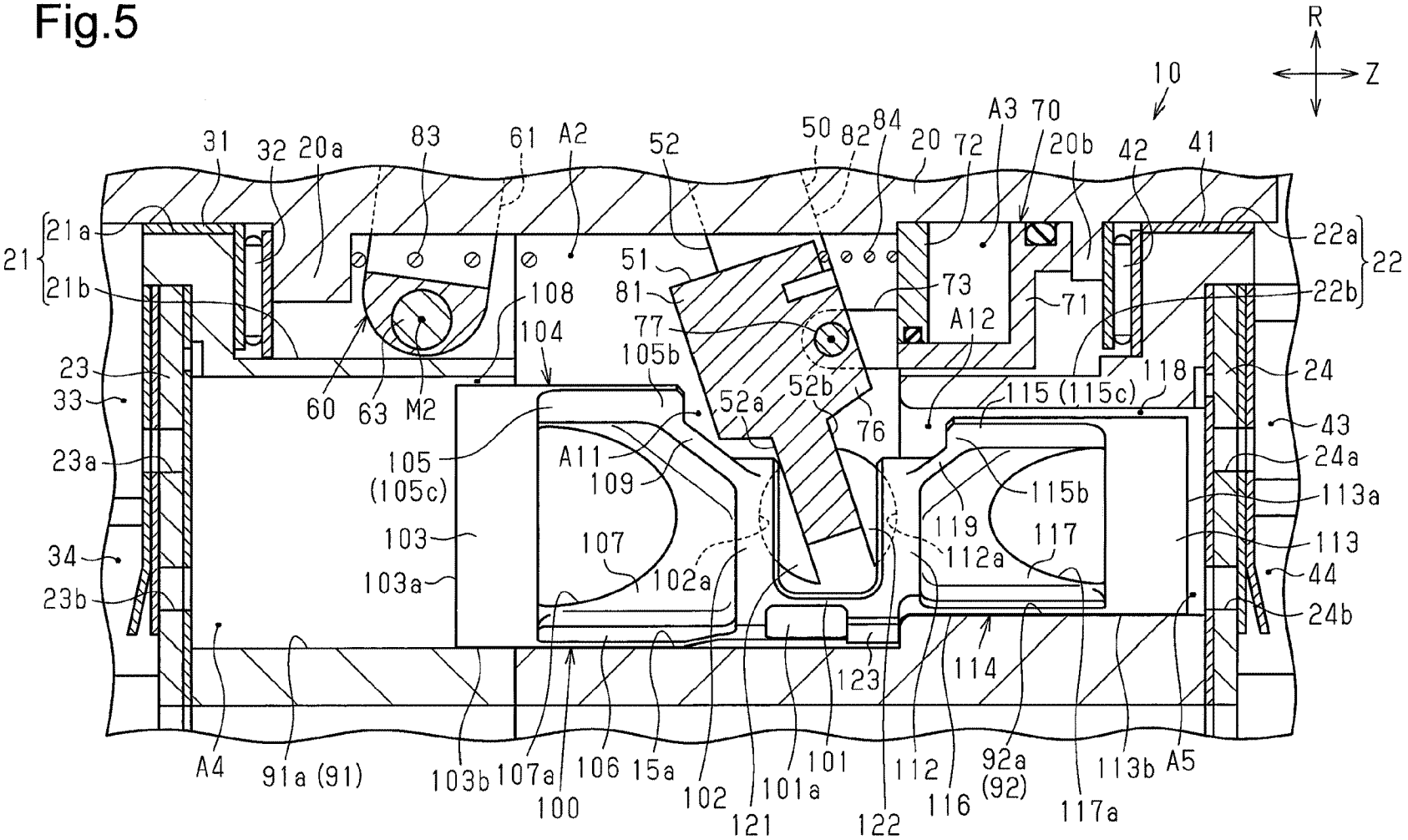
FIG. 5 is an enlarged view schematically showing the double-headed piston shown in FIG. 1 and the surrounding of the double-headed piston.
Figure 6:
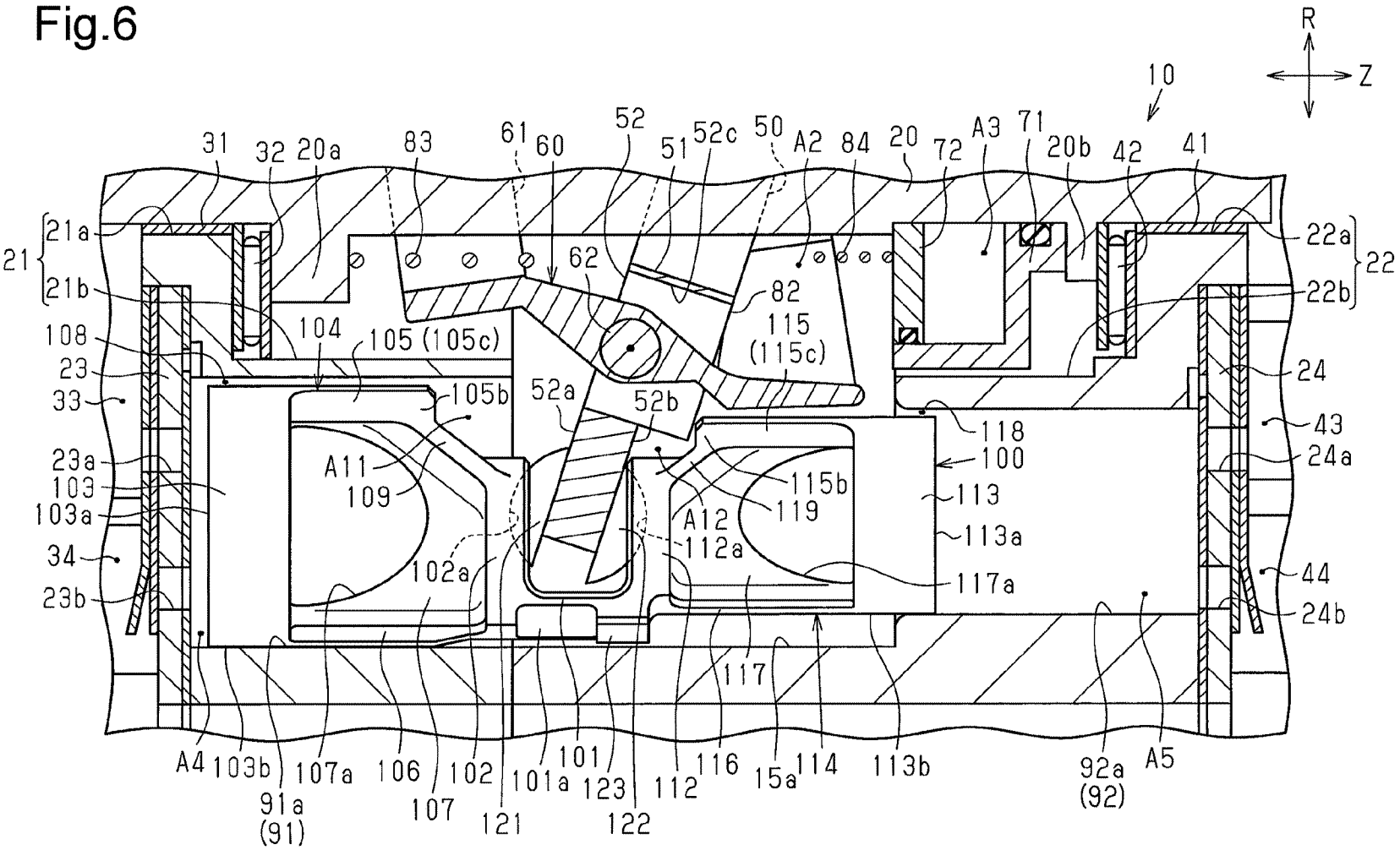
FIG. 6 is an enlarged view schematically showing the double-headed piston shown in FIG. 1 and the surrounding of the double-headed piston.

As shown in FIGS. 2 and 3, the two shoe holders 102 and 112 include semi-spherical surfaces 102*a* and 112*a*. The semi-spherical surfaces 102*a* and 112*a* are recessed away from each other. As shown in FIGS. 5 and 6, the circumferential portion of the swash plate 50 is arranged between the shoe holders 102 and 112.

As shown in FIGS. 5 and 6, the first shoe 121 of the two shoes 121 and 122 is located between the first inclined surface 52*a* of the swash plate 50 and the first semi-spherical surface 102*a* of the first shoe holder 102, and the second shoe 122 is located between the second inclined surface 52*b* of the swash plate 50 and the second semi-spherical surface 112*a* of the second shoe holder 112. The two shoes 121 and 122 are semi-spherical. The two shoes 121 and 122 include end surfaces that abut against the circumferential portions of the corresponding inclined surfaces 52*a* and 52*b* and spherical surfaces that abut against the corresponding semi-spherical surfaces 102*a* and 112*a*. The shoe holders 102 and 112 hold the two shoes 121 and 122 with the two shoes 121 and 122 holding the circumferential portions of the swash plate 50. Thus, the two shoes 121 and 122 couple the double-headed piston 100 to the swash plate 50.

In such a structure, rotation of the swash plate 50 applies load, including a component in the axial direction Z, to the double-headed piston 100 through the two shoes 121 and 122. This converts the rotation of the swash plate 50 into reciprocation of the double-headed piston 100. In this case, the stroke of the double-headed piston 100 changes in accordance with the inclination angle of the swash plate 50.

The neck 101 is located at the circumferential side of the swash plate 50, more specifically, at the outer side of the swash plate 50 in the radial direction R. The neck 101 is larger in the widthwise direction W than in the radial direction R so that the neck 101 is deformable in the radial direction R. More specifically, the neck 101 is plate-shaped, and the radial direction R of the neck 101 refers to a thickness-wise direction. The section modulus of the neck 101 is smaller in the radial direction R than in the widthwise direction W. The two shoe holders 102 and 112 are located at the two ends of the inner surface of the neck 101 in the axial direction of the double-headed piston 100.

Figure 4:
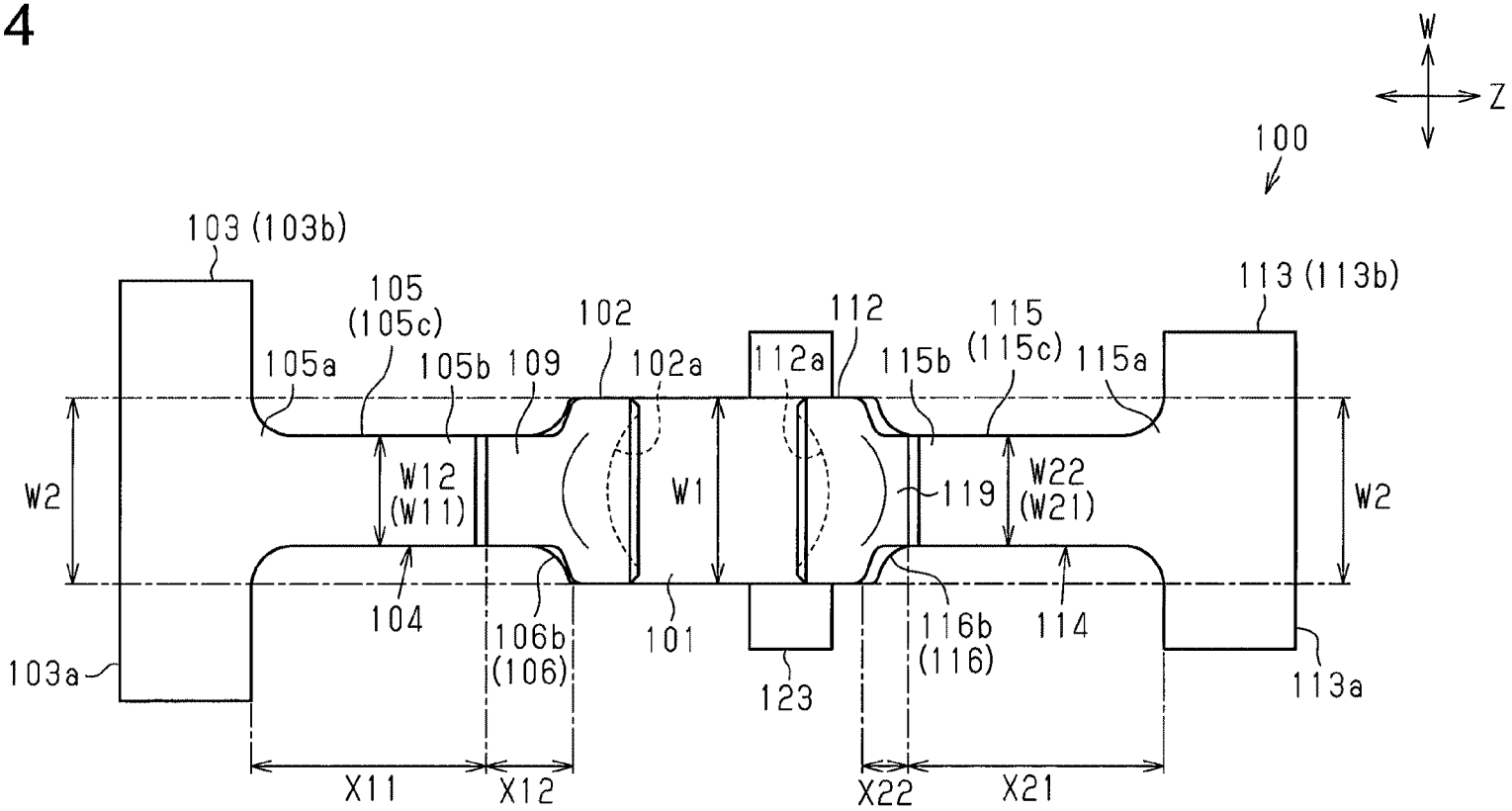
FIG. 4 is a plan view of the double-headed piston shown in FIG. 1 as viewed from a radially inner side.

As shown in FIG. 4, the width W1 of the neck 101 is the same as the shoe width W2 of the shoe holders 102 and 112. However, the width W1 of the neck 101 may be larger than the shoe width W2.

As shown in FIG. 3, the outer surface of the neck 101 is curved in conformance with a wall surface 91*a* that is the wall surface of the first cylinder bore 91. The outer surface of the neck 101 includes neck recesses 101*a* that are recessed from the outer surface of the neck 101 toward the inner side in the radial direction R. The two neck recesses 101*a* are separated from each other in the widthwise direction W. Thus, the two ends of the neck 101 in the widthwise direction are thinner than the central portion of the neck 101 in the widthwise direction W and easily deformed in the radial direction R.

As shown in FIGS. 2 and 3, each of the heads 103 and 113 is tubular and has a bottom. The heads 103 and 113 include end surfaces 103*a* and 113*a*, which have a slightly smaller diameter than the first wall surface 91*a* of the first cylinder bore 91 and a second wall surface 92*a* of the second cylinder bore 92, and side surfaces 103*b* and 113*b* (i.e., outer circumferential surfaces 103*b* and 113*b*), respectively. Further, the heads 103 and 113 open toward the shoe holders 102 and 112. The side surfaces 103*b* and 113*b* of the heads 103 and 113 oppose the wall surfaces 91*a* and 92*a* of the cylinder bores 91 and 92. Thus, as shown in FIGS. 5 and 6, a first gap 108 is formed between the first wall surface 91*a* of the first cylinder bore 91 and the side surface 103*b* of the first head 103, and a second gap 118 is formed between the second wall surface 92*a* of the second cylinder bore 92 and the side surface 113*b* of the second head 113. The first head 103 is at least partially accommodated in the first cylinder bore 91 regardless of where the double-headed piston 100 is located. The second head 113 is at least partially accommodated in the second cylinder bore 92 regardless of where the double-headed piston 100 is located.

The cylinder bores 91 and 92 respectively include compression chambers A4 and A5 that are defined by the end surfaces 103*a* and 113*a* of the heads 103 and 113, the wall surfaces 91*a* and 92*a* of the cylinder bores 91 and 92, and the valve/port bodies 23 and 24. The compression chambers A4 and A5 are in communication with the suction chambers 33 and 43 with the suction ports 23*a* and 24*a* located in between and are in communication with the discharge chambers 34 and 44 with the discharge ports 23*b* and 24*b* located in between.

In such a structure, reciprocation of the double-headed piston 100 draws fluid from the suction chambers 33 and 43 into the compression chambers A4 and A5, where the fluid is compressed. Then, the fluid is discharged into the discharge chambers 34 and 44. The stroke of the double-headed piston 100 changes in accordance with the inclination angle of the swash plate 50 and varies the displacement of the compressed fluid. That is, the compressor 10 of the present embodiment is of a variable displacement type.

The double-headed piston 100 receives load from the swash plate 50 through the two shoes 121 and 122 and receives compression reaction force that result from compression of fluid in the compression chambers A4 and A5. Further, the fluid in the compression chambers A4 and A5 may leak from the gaps 108 and 118.

In the present embodiment, the head 103 has a larger diameter than the second head 113. Thus, the first head 103 and the second head 113 include fluid pressure receiving areas that differ from each other.

Further, the first cylinder bore 91 is larger than the second cylinder bore 92 in correspondence with the difference in diameter of the two heads 103 and 113. More specifically, the first wall surface 91*a* has a larger diameter than the second wall surface 92*a*. Thus, the two gaps 108 and 118 have substantially the same size (more specifically, same length in radial direction R).

As shown in FIGS. 5 and 6, the wall surfaces 91*a* and 92*a* of the two cylinder bores 91 and 92, which are coaxially opposed to each other, have different diameters. Thus, the outer portion of the first wall surface 91*a* in the radial direction R is located outward in the radial direction R from the outer side of the second wall surface 92*a* in the radial direction R. The outer portion of the first wall surface 91*a* in the radial direction R is flush with a side wall inner surface 15*a* that is an inner surface of the side wall of the second cylinder block 15 that defines the swash plate chamber A2. The side wall inner surface 15*a* and the second wall surface 92*a* form a step.

As shown in FIG. 4, the two coupling portions 104 and 114 are both entirely narrower than the neck 101, which has the width W1, so that the coupling portions 104 and 114 are deformable. The section modulus of each of the two coupling portions 104 and 114 is smaller in the widthwise direction W than in the radial direction R.

The first inner portion 105 and the first outer portion 106 of the first coupling portion 104 each have an outer surface curved in conformance with the first wall surface 91*a* of the first cylinder bore 91. The second inner portion 115 and the second outer portion 116 of the second coupling portion 114 each have an outer surface curved in conformance with the second wall surface 92*a* of the second cylinder bore 92.

As shown in FIGS. 5 and 6, the first outer portion 106 extends in the axial direction of the double-headed piston 100 from the outer portion of the first head 103 in the radial direction R and couples the first head 103 to the first shoe holder 102 with the neck 101. More specifically, the first outer portion 106 connects the end of the neck 101 where the first shoe holder 102 is arranged to the outer portion of the first head 103 in the radial direction R. The first outer portion 106 is a plate having a width in the widthwise direction W and a thickness in the radial direction R.

In the present embodiment, the first outer portion 106 includes two ends 106*a* and 106*b* in the axial direction of the double-headed piston 100. The two ends 106*a* and 106*b* are inversely-tapered and gradually widened as the two ends 106*a* and 106*b* become farther from each other. Thus, the width W11 of the first outer portion 106 varies in the axial direction of the double-headed piston 100.

In such a structure, as shown in FIG. 4, the first outer portion 106 is configured so that the width W11 is less than or equal to the width W1 at any position on the first outer portion 106. In other words, the maximum of the width W11 of the first outer portion 106 is less than or equal to the width W1 of the neck 101. The part of the first outer portion 106 located between the two ends 106*a* and 106*b*, more specifically, the part where the width W11 is fixed, is narrower than the shoe width W2.

The first inner portion 105 extends in the axial direction of the double-headed piston 100 from the inner portion of the first head 103 in the radial direction R. The first inner portion 105 includes a first basal portion 105*a* located near the first head 103 and a first distal portion 105*b* located near the first shoe holder 102. The first distal portion 105*b* corresponds to "an end of the inner portion near the shoe holder."

The first inner portion 105 is a plate having a width in the widthwise direction W and a thickness in the radial direction R. The length X11 of the first inner portion 105 in the axial direction of the double-headed piston 100 is shorter than the first outer portion 106. Thus, the first distal portion 105*b* of the first inner portion 105 is located between the first head 103 and the first shoe holder 102 as viewed in the radial direction R.

In the present embodiment, the part of the first inner portion 105 excluding the first basal portion 105*a* has a fixed width. The first basal portion 105*a* of the first inner portion 105 is inversely-tapered and gradually widened from the first distal portion 105*b* toward the first head 103. Thus, the width W12 of the first inner portion 105 varies in the axial direction.

In such a structure, the first inner portion 105 is configured so that the width W12 is less than or equal to the width W1 at any position on the first inner portion 105. In other words, the maximum of the width W12 of the first inner portion 105 is less than or equal to the width W1 of the neck 101.

The first inner portion 105 includes a first narrow portion 105*c* that is narrower than the shoe width W2. The first narrow portion 105*c* is at least partially located closer to the first head 103 than the first shoe holder 102 in the first inner portion 105. In other words, the first narrow portion 105*c* is at least partially located between the first shoe holder 102 and the first head 103. In the present embodiment, the entire first inner portion 105 is the first narrow portion 105*c*. That is, the maximum of the width W12 of the first inner portion 105 is less than or equal to the shoe width W2.

In the present embodiment, the width W11 of the part having a fixed width (portion extending in fixed width) in the outer portion 106 is equal to the width W12 of the part having a fixed width in the inner portion 105. Thus, most of the first outer portion 106 overlaps the first inner portion 105 in FIG. 4.

The width of the first coupling portion 104 is the larger one of the width W11 of the first outer portion 106 and the width W12 of the first inner portion 105. With the structure in which the two widths W11 and W12 vary in the axial direction, the width of the first coupling portion 104 is the maximum one of the two widths W11 and W12.

As shown in FIGS. 5 and 6, the first inner portion 105 is located at the inner side of the first shoe holder 102 in the radial direction R. Thus, the first distal portion 105*b* of the first inner portion 105 and the first shoe holder 102 form a step.

The first coupling portion 104 includes a first rib 109 that connects the first shoe holder 102 and the first distal portion 105*b* of the first inner portion 105, which form a step. The first rib 109 connects the first distal portion 105*b* of the first inner portion 105 to the first shoe holder 102 so that a first space A11 is defined beside the first distal portion 105*b* of the first inner portion 105 as viewed in the widthwise direction W. More specifically, the first rib 109 is inclined as viewed in the widthwise direction W. As shown in FIG. 4, the length X11 of the first inner portion 105 in the axial direction of the double-headed piston 100 is longer than the length X12 of the first rib 109.

In such a structure, as shown in FIG. 5, when the swash plate 50 rotates, the first projection 81 passes by the first space A11. Thus, the double-headed piston 100 does not interfere with the first projection 81. The first space A11 is configured so that the double-headed piston 100 does not interfere with the first projection 81 regardless of the inclination angle of the swash plate 50 and the position of the double-headed piston 100 in the two cylinder bores 91 and 92.

As shown in FIGS. 2 and 3, the widthwise direction W of the first plate 107 of the first coupling portion 104 is a thickness-wise direction. That is, the first plate 107 has a thickness corresponding to the widthwise direction W. The thickness of the first plate 107 is less than the two widths W11 and W12. The first plate 107 includes a first through hole 107*a* extending in the widthwise direction W. The first through hole 107*a* is, for example, recessed toward the first shoe holder 102 as viewed in the widthwise direction W and is in communication with a space of the first head 103, which is tubular and has a bottom.

The second coupling portion 114 is basically the same as the first coupling portion 104 except that, for example, the second coupling portion 114 in the axial direction of the double-headed piston 100 is longer than the first coupling portion 104.

More specifically, as shown in FIG. 3, the second outer portion 116 extends in the axial direction of the double-headed piston 100 from the outer portion of the second head 113 in the radial direction R and couples the second head 113 to the second shoe holder 112 with the neck 101. The second outer portion 116 includes two ends 116*a* and 116*b* in the axial direction of the double-headed piston 100. The two ends 116*a* and 116*b* are inversely-tapered and gradually widened as the two ends 116*a* and 116*b* become farther from each other. Thus, the width W21 of the second outer portion 116 varies in the axial direction of the double-headed piston 100.

In such a structure, as shown in FIG. 4, the second outer portion 116 is configured so that the width W21 is less than or equal to the width W1 at any position on the second outer portion 116. The part of the second outer portion 116 located between the two ends 116*a* and 116*b*, more specifically, the part where the width W21 is fixed, is narrower than the shoe width W2.

As shown in FIGS. 2 and 3, the second inner portion 115 extends in the axial direction of the double-headed piston 100 from the inner portion of the second head 113 in the radial direction R. The second inner portion 115 includes a second basal portion 115*a* located near the second head 113 and a second distal portion 115*b* located near the second shoe holder 112. The second distal portion 115*b* is located between the second head 113 and the second shoe holder 112 as viewed in the radial direction R. In the present embodiment, the part of the second inner portion 115 excluding the second basal portion 115*a* has a fixed width. The second basal portion 115*a* of the second inner portion 115 is inversely-tapered and gradually widened from the second distal portion 115*b* toward the second head 113. The second distal portion 115*b* corresponds to "an end of the inner portion near the shoe holder."

In such a structure, as shown in FIG. 4, the second inner portion 115 is configured so that the width W22, which is the width of the second inner portion 115, is less than or equal to the width W1 at any position on the second inner portion 115. In other words, the maximum of the width W22 of the second inner portion 115 is less than or equal to the width W1 of the neck 101.

The second inner portion 115 includes a second narrow portion 115*c* that is narrower than the shoe width W2. The second narrow portion 115*c* is at least partially located closer to the second head 113 than the second shoe holder 112 in the second inner portion 115. In other words, the second narrow portion 115*c* is at least partially located between the second shoe holder 112 and the second head 113. In the present embodiment, the entire second inner portion 115 is the second narrow portion 115*c*. That is, the maximum of the width W22 of the second inner portion 115 is less than or equal to the shoe width W2.

The width of the second coupling portion 114 is the larger one of the width W21 of the second outer portion 116 and the width W22 of the second inner portion 115. With the structure in which the two widths W21 and W22 vary in the axial direction, the width of the second coupling portion 114 is the maximum one of the two widths W21 and W22.

As shown in FIGS. 5 and 6, the second inner portion 115 is located at the inner side of the second shoe holder 112 in the radial direction R. Thus, the second distal portion 115*b* of the second inner portion 115 and the second shoe holder 112 form a step. The second inner portion 115 includes a second rib 119 that connects the second shoe holder 112 and the second distal portion 115*b* of the second inner portion 115, which form a step. The second rib 119 connects the second distal portion 115*b* of the second inner portion 115 to the second shoe holder 112 so that a second space A12 is defined beside the second distal portion 115*b* of the second inner portion 115 as viewed in the widthwise direction W. More specifically, the second rib 119 is inclined as viewed in the widthwise direction W. As shown in FIG. 4, the length X21 of the second inner portion 115 in the axial direction of the double-headed piston 100 is greater than the length X22 of the second rib 119.

In such a structure, as shown in FIG. 6, when the swash plate 50 rotates, the second projection 82 passes by the second space A12. Thus, the double-headed piston 100 does not interfere with the second projection 82. The second space A12 is configured so that the coupling receiving portion 76 and the double-headed piston 100 do not interfere with the second projection 82 regardless of the inclination angle of the swash plate 50 and the position of the double-headed piston 100 in the two cylinder bores 91 and 92.

Further, the thickness of the second plate 117 of the second coupling portion 114 is less than the two widths W21 and W22. The second plate 117 includes a second through hole 117*a* extending in the widthwise direction W. The second through hole 117*a* is, for example, recessed toward the second shoe holder 112 as viewed in the widthwise direction W and is in communication with a space of the second head 113, which is tubular and has a bottom.

As shown in FIGS. 3 to 6, the outer surface of the neck recesses 101*a* includes a rotation stopper 123 that restricts rotation of the double-headed piston 100 in the two cylinder bores 91 and 92. The rotation stopper 123 is located closer to the second shoe holder 112 than the neck recesses 101*a*, more specifically, on the end of the outer surface of the neck 101 that is closer to the second shoe holder 112. In other words, the rotation stopper 123 may be located on the outer surface of the neck 101 closer to the second head 113 than the first head 103 or on the outer surface of the neck 101 at a location that is closer to the second coupling portion 114 than the first coupling portion 104. The rotation stopper 123 extends in the widthwise direction W. As shown in FIG. 4, the two ends of the rotation stopper 123 in the widthwise direction W extend out of the neck 101 as viewed in the radial direction R. The rotation stopper 123 includes an outer surface curved in conformance with the side wall inner surface 15*a*. The outer surface of the rotation stopper 123 abuts against the side wall inner surface 15*a* to restrict rotation of the double-headed piston 100 about the piston axis L3.

In the present embodiment, the rotation stopper 123 is arranged near the second shoe holder 112 and not near the first shoe holder 102. Thus, the portion of the neck 101 near the first shoe holder 102 is deformed more easily than the portion near the second shoe holder 112, and the portion of the neck 101 near the second shoe holder 112 has a higher strength than the portion of the neck 101 near the first shoe holder 102.

Further, the double-headed piston 100 is movable to where the rotation stopper 123 abuts against the open end of the first cylinder bore 91 that is closer to the swash plate chamber A2. That is, the portion of the neck 101 near the first shoe holder 102 of the double-headed piston 100 can be partially inserted into the first cylinder bore 91.

The operation of the present embodiment will now be described.

The double-headed piston 100 is arranged so that the piston axis L3 is coaxial with the two cylinder bore axes L1 and L2. In this case, due to machining errors or the like, the piston axis L3 may not be coaxial with the two cylinder bore axes L1 and L2 and may be slightly misaligned from the two cylinder bore axes L1 and L2. Further, the two cylinder bore axes L1 and L2 may also not be coaxial with each other and may not be in alignment with each other. That is, the coaxiality in the double-headed piston 100 may differ from the coaxialities in the two cylinder bores 91 and 92, and the coaxialities in the two cylinder bores 91 and 92 may differ from each other.

Rotation of the swash plate 50 applies load, which includes a component in the radial direction R and a component in the widthwise direction W, to the double-headed piston 100 through the shoes 121 and 122. The load deforms the double-headed piston 100 in at least one of the radial direction R and the widthwise direction W. This limits occurrence of jamming between the double-headed piston 100 and the cylinder bores 91 and 92 even when the piston axis L3 is not aligned with the two cylinder bore axes L1 and L2.

Figure 7:
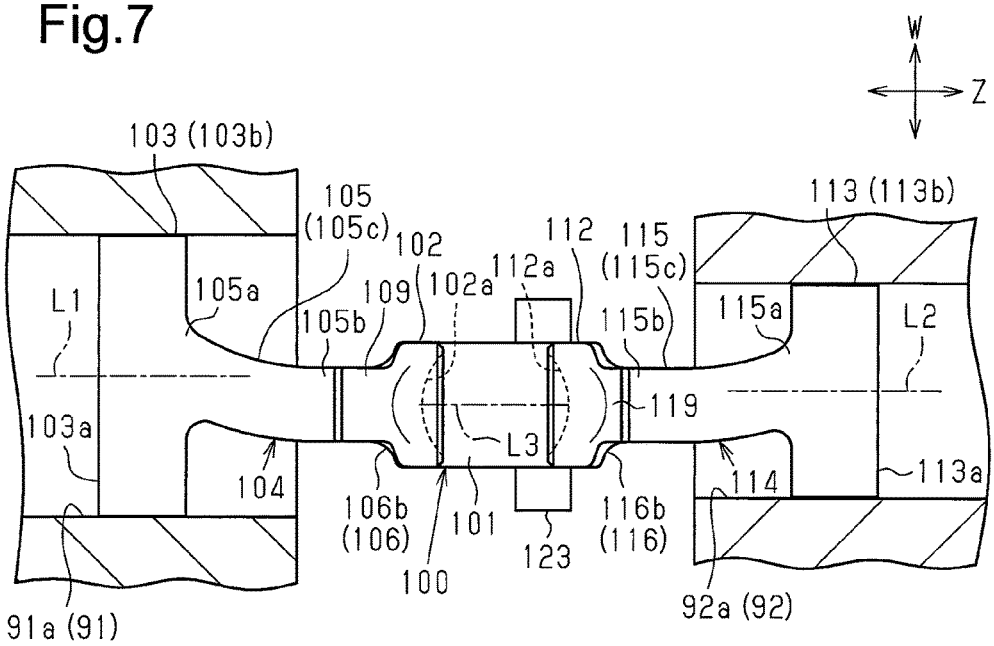
FIG. 7 is a schematic view showing an example of deformation of the double-headed piston shown in FIG. 1.
Figure 8:
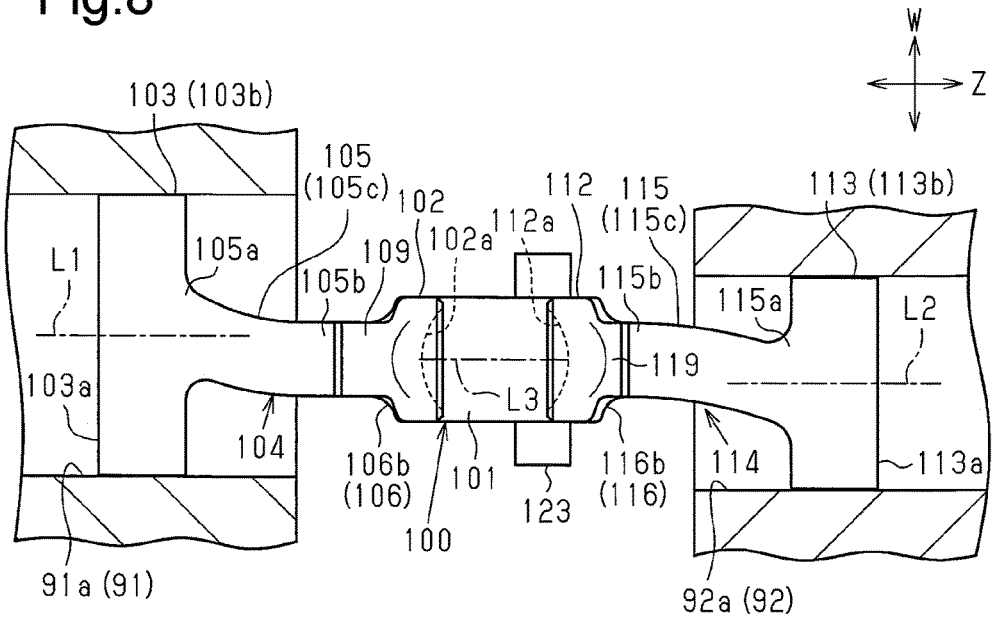
FIG. 8 is a schematic view showing an example of deformation of the double-headed piston shown in FIG. 1.

For example, as shown in FIGS. 7 and 8, the piston axis L3 may be shifted in the widthwise direction W from the two cylinder bore axes L1 and L2. In this case, the load from the swash plate 50 deforms the two coupling portions 104 and 114 in the widthwise direction W and limits occurrence of jamming between the double-headed piston 100 and the cylinder bores 91 and 92.

In this case, as shown in FIG. 7, when the cylinder bore axes L1 and L2 are shifted in the same direction from the piston axis L3, the two coupling portions 104 and 114 are deformed in the same direction with respect to the widthwise direction W. This bends the double-headed piston 100 so that the double-headed piston 100 is entirely convex or concave in the widthwise direction W, as viewed in the radial direction R.

As shown in FIG. 8, when the cylinder bore axes L1 and L2 are shifted in opposite directions from the piston axis L3, the two coupling portions 104 and 114 are deformed in different directions with respect to the widthwise direction W. This bends the double-headed piston 100 so that the double-headed piston 100 is S-shaped as viewed in the radial direction R.

Figure 9:
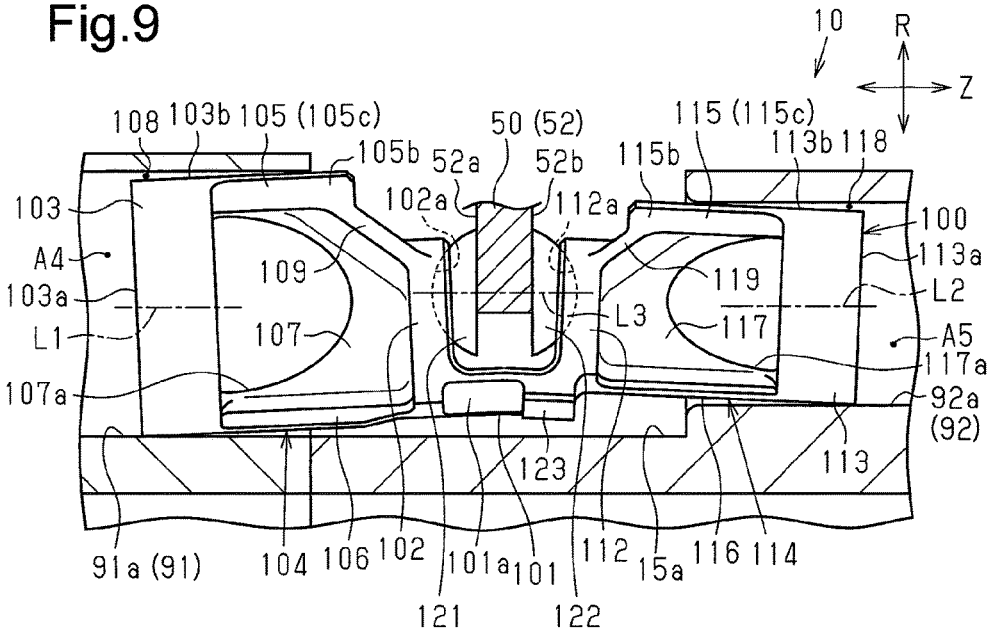
FIG. 9 is a schematic view showing an example of deformation of the double-headed piston shown in FIG. 1.

Further, for example, as shown in FIG. 9, the piston axis L3 may be shifted in the radial direction R from the two cylinder bore axes L1 and L2. In this case, the neck 101 is deformed in the radial direction R. This limits occurrence of jamming between the double-headed piston 100 and the cylinder bores 91 and 92.

When the neck 101 is deformed in the radial direction R, the inner portions 105 and 115 abut against (in other words, slide along) the wall surfaces 91*a* and 92*a* of the cylinder bores 91 and 92. The abut portions of the wall surfaces 91*a* and 92*a* receive bending load that deforms the abut portions toward the inner side in the radial direction R.

To facilitate understanding, the first and second cylinder bore axes L1 and L2 are greatly misaligned from the piston axis L3 in FIGS. 7 to 9. Further, to facilitate understanding, the gaps 108 and 118 are omitted in FIGS. 8 and 9.

The above embodiment has the advantages described below.

(1) The compressor 10 is of a double-headed piston type swash plate type that compresses fluid in the compression chambers A4 and A5 of the cylinder bores 91 and 92 when rotation of the swash plate 50 reciprocates the double-headed piston 100 in the two cylinder bores 91 and 92. The two cylinder bores 91 and 92 and the double-headed piston 100 define the compression chambers A4 and A5.

The double-headed piston 100 includes the two shoe holders 102 and 112, which hold the two shoes 121 and 122 and are opposed to each other in the axial direction of the double-headed piston 100, and the neck 101, which couples the two shoe holders 102 and 112 and is located at the circumferential side of the swash plate 50. The double-headed piston 100 includes the two heads 103 and 113, which are respectively arranged at the two ends of the double-headed piston 100 in the axial direction, and the two coupling portions 104 and 114, which respectively couple the two heads 103 and 113 to the two shoe holders 102 and 112. The two heads 103 and 113 are located in the cylinder bores 91 and 92 with the gaps 108 and 118 formed between the heads 103 and 113 and the wall surfaces 91*a* and 92*a* of the cylinder bores 91 and 92, respectively.

The coupling portions 104 and 114 respectively include the outer portions 106 and 116, which extend in the axial direction of the double-headed piston 100, and the inner portions 105 and 115, which are located at the inner sides of the outer portions 106 and 116 in the radial direction R and extended in the axial direction of the double-headed piston 100. The inner portions 105 and 115 are opposed to the outer portions 106 and 116 in the radial direction R.

In such a structure, the neck 101 is larger in the widthwise direction W than in the radial direction R so that the neck 101 is deformable in the radial direction R, which is the direction in which the inner portions 105 and 115 are opposed to the outer portions 106 and 116. The coupling portions 104 and 114 are entirely narrower than the width W1 of the neck 101 so that the coupling portions 104 and 114 are deformable in the widthwise direction W. The inner portions 105 and 115 respectively include the narrow portions 105*c* and 115*c*, which are narrower than the shoe width W2. The narrow portions 105*c* and 115*c* are at least partially located closer to the heads 103 and 113 than the shoe holders 102 and 112 in the inner portions 105 and 115, respectively.

In such a structure, the double-headed piston 100 is deformed in at least one of the radial direction R and the widthwise direction W. This limits jamming that would be caused when the piston axis L3 is not in alignment with the cylinder bores axes L1 and L2.

More specifically, as described above, when the double-headed piston 100 reciprocates in the two cylinder bores 91 and 92 under a situation in which the piston axis L3 is not in alignment with the cylinder bore axes L1 and L2, the double-headed piston 100 is caught by the wall surfaces 91*a* and 92*a* of the two cylinder bores 91 and 92. This hinders reciprocation of the double-headed piston 100. That is, the double-headed piston 100 may be jammed by the cylinder bores 91 and 92. In particular, jamming of the double-headed piston 100 easily occurs in the cylinder bores 91 and 92 when the gaps 108 and 118 are small.

In this regard, the double-headed piston 100 of the present embodiment deforms in at least one of the radial direction R and the widthwise direction W so that the double-headed piston 100 smoothly reciprocates in the two cylinder bores 91 and 92 even when a difference in the coaxialities occurs. Thus, since there is no need to enlarge the gaps 108 and 118 in order to limit jamming, the gaps 108 and 118 may be reduced in size. This limits increases in blow-by that would be produced when enlarging the gaps 108 and 118 and allows the double-headed piston 100 to smoothly reciprocate (slide) by limiting occurrence of jamming. Further, deformation of the double-headed piston 100 increases the area of the double-headed piston 100 that contacts the cylinder bores 91 and 92 when the double-headed piston 100 slides along the walls of the cylinder bores 91 and 92. This reduces local wear caused by the sliding.

In particular, the coupling portions 104 and 114 of the present embodiment have smaller widths than the width W1 of the neck 101. Thus, the coupling portions 104 and 114 and the neck 101 are both deformed. This disperses the load in the widthwise direction W received by the coupling portions 104 and 114 and the neck 101 and reduces the load applied to the neck 101.

Further, the inner portions 105 and 115 respectively include the narrow portions 105*c* and 115*c*, each having a smaller width than the shoe width W2, and the first narrow portions 105*c* and 115*c* are at least partially separated from the shoe holders 102 and 112. More specifically, the first narrow portions 105*c* and 115*c* are at least partially located closer to the heads 103 and 113 than the shoe holders 102 and 112 in the inner portions 105 and 115. This allows the coupling portions 104 and 114 to be easily deformed and thus limits jamming in a further preferred manner. In addition, with respect to deformation in the widthwise direction W, priority is given to the coupling portions 104 and 114 over the neck 101. This limits deformation of the neck 101 in both of the radial direction R and the widthwise direction W and reduces the load on the neck 101.

A single-headed piston, which reciprocates when the swash plate 50 rotates, receives side force from the swash plate 50. Thus, the portion of the single-headed piston located at the inner side in the radial direction R and near the head is usually wide in the widthwise direction W in order to receive the side force. Such a single-headed piston resists deformation in the widthwise direction W. In this regard, the double-headed piston 100 of the present embodiment reduces jamming by narrowing the parts of the inner portions 105 and 115 located near the heads 103 and 113 that would usually be wide. This allows the double-headed piston 100 to be deformed in the widthwise direction W in a further preferred manner.

(2) The coupling portions 104 and 114 respectively include the plates 107 and 117 that couple the inner portions 105 and 115 to the outer portions 106 and 116. The plates 107 and 117 each have a thickness in the widthwise direction W. The thickness of the first plate 107 is less than the width W12 of the first inner portion 105 and the width W11 of the first outer portion 106, and the thickness of the second plate 117 is less than the width W22 of the second inner portion 115 and the width W21 of the second outer portion 116. Such a structure easily deforms the coupling portions 104 and 114 in the widthwise direction W and ensures the strength necessary to counter the load from the swash plate 50.

(3) The plates 107 and 117 respectively include the through holes 107*a* and 117*a* extending through the plates 107 and 117 in the widthwise direction W. Such a structure allows the coupling portions 104 and 114 to easily deform and reduces the weight of the double-headed piston 100. In particular, the plates 107 and 117 include the through holes 107*a* and 117*a*. This leaves portions of the plates 107 and 117, more specifically, portions closer to the two shoe holders 102 and 112. Accordingly, the strength necessary for the double-headed piston 100, i.e., the strength necessary for holding the shoes 121 and 122, is obtained, and the above advantage is obtained.

(4) The inner portions 105 and 115 are extended in the axial direction of the double-headed piston 100 from the inner sides of the heads 103 and 113 in the radial direction R and located at the inner sides of the shoe holders 102 and 112 in the radial direction R. The distal portions 105*b* and 115*b*, which are the ends of the inner portions 105 and 115 near the shoe holders 102 and 112, are located between the shoe holders 102 and 112 and the heads 103 and 113 as viewed in the radial direction R. The coupling portions 104 and 114 respectively include the ribs 109 and 119 that connect the distal portions 105*b* and 115*b* and the shoe holders 102 and 112 so that the spaces A11 and A12 are defined beside the distal portions 105*b* and 115*b* as viewed in the widthwise direction W.

In such a structure, the inner portions 105 and 115 are located at the inner sides of the shoe holders 102 and 112 in the radial direction R. As a result, the inner portions 105 and 115 are closer to the inner sides of the wall surfaces 91*a* and 92*a* in the radial direction R than the shoe holders 102 and 112. Thus, when deformation of the neck 101 bends the double-headed piston 100 so that the double-headed piston 100 is bulged toward the inner side in the radial direction R, the inner portions 105 and 115 (more specifically, distal portions 105*b* and 115*b*) are given priority over the shoe holders 102 and 112 for abutment (sliding) against the wall surfaces 91*a* and 92*a*. The abut portion receives the bending load that is applied from the swash plate 50 toward the inner side in the radial direction R.

However, when the inner portions 105 and 115 are located at the inner sides of the shoe holders 102 and 112 in the radial direction R, the inner portions 105 and 115 may interfere with the swash plate 50. In particular, the swash plate 50 of the present embodiment includes the coupling receiving portion 76 and the two projections 81 and 82 and may easily interfere with the inner portions 105 and 115. In this regard, the present embodiment includes the spaces A11 and A12 and thus avoids interference between the inner portions 105 and 115 and the swash plate 50. This avoids undesirable situations that would be caused when the inner portions 105 and 115 are located at the inner sides of the shoe holders 102 and 112 in the radial direction R.

(5) The lengths X11 and X21 of the inner portions 105 and 115 are larger than the lengths X12 and X22 of the ribs 109 and 119 in the axial direction of the double-headed piston 100. In such a structure, the inner portions 105 and 115 extend in the axial direction of the double-headed piston 100 to avoid interference with the swash plate 50. This avoids interference between the inner portions 105 and 115 and the swash plate 50 and increases the strength for bending load of the double-headed piston 100 in the radial direction R.

More specifically, in order to avoid interference between the inner portions 105 and 115 and the swash plate 50, the lengths X12 and X22 of the ribs 109 and 119 may be set to be larger than the lengths X11 and X21 of the inner portions 105 and 115 to obtain the spaces A11 and A12 sufficiently. However, when the lengths X12 and X22 of the ribs 109 and 119 are increased, the distance from the distal portions 105*b* and 115*b* of the inner portions 105 and 115 to the shoe holders 102 and 112 that receive load from the swash plate 50 is increased. This easily increases bending moment that is produced when the distal portions 105*b* and 115*b* of the inner portions 105 and 115 abut against the wall surfaces 91*a* and 92*a*. This also easily decreases the strength (resistance) that counters bending load. In the present embodiment, interference between the swash plate 50 and the inner portions 105 and 115 is avoided, and the lengths X11 and X21 of the inner portions 105 and 115 are set to be larger than the lengths X12 and X22 of the ribs 109 and 119. This reduces the bending moment that is produced when the distal portions 105*b* and 115*b* of the inner portions 105 and 115 abut against the wall surfaces 91*a* and 92*a*. Accordingly, the above advantage is obtained.

(6) The outer surface of the neck 101 includes the neck recesses 101*a*. This allows the neck 101 to be deformed more easily in the radial direction R and reduces the weight of the double-headed piston 100.

(7) The compressor 10 includes the actuator 70 that changes the inclination angle of the swash plate 50. The actuator 70 includes the movable body 71, which is movable in the axial direction Z of the rotation shaft 20, and the partition 72, which defines the control chamber A3 in cooperation with the movable body 71. The compressor 10 changes the inclination angle of the swash plate 50 when the movable body 71 moves in accordance with the pressure of the control chamber A3. Thus, adjustment of the pressure of the control chamber A3 allows for variable displacement.

When variable displacement is performed, the controllability of the variable displacement needs to be increased. In the present embodiment, the coupling portions 104 and 114 are narrower than the neck 101, and the inner portions 105 and 115 respectively include the narrow portions 105*c* and 115*c* so that the coupling portions 104 and 114 are easily deformed in the widthwise direction W. Thus, as compared to a piston that receives side force over a large dimension in the widthwise direction W, the weight of the double-headed piston 100 is reduced. This limits jamming and increases the controllability of variable displacement.

(8) The second head 113 has a smaller diameter than the first head 103. In such a structure, the first head 103 and the second head 113 respectively include refrigerant pressure receiving areas that differ from each other. Accordingly, the first head 103 and the second head 113 have different compression reaction forces that result from the compression of fluid. This allows variable displacement to be performed relatively easily. Thus, the controllability of variable displacement is increased.

(9) The neck recesses 101 include the rotation stopper 123 that restricts rotation of the double-headed piston 100 about the piston axis L3 in the two cylinder bores 91 and 92. The rotation stopper 123 is located at the portion of the neck 101 that is closer to the second head 113 than the first head 103. In such a structure, the rotation stopper 123 is located at the small diameter side where the strength has a tendency of being lower than the large diameter side. This limits decreases in the strength of the second head 113, which is an undesirable situation that may occur when the heads 103 and 113 have different diameters.

It should be apparent to those skilled in the art that the present invention may be embodied in many other specific forms without departing from the spirit or scope of the invention. Particularly, it should be understood that the present invention may be embodied in the following forms.

Figure 10:
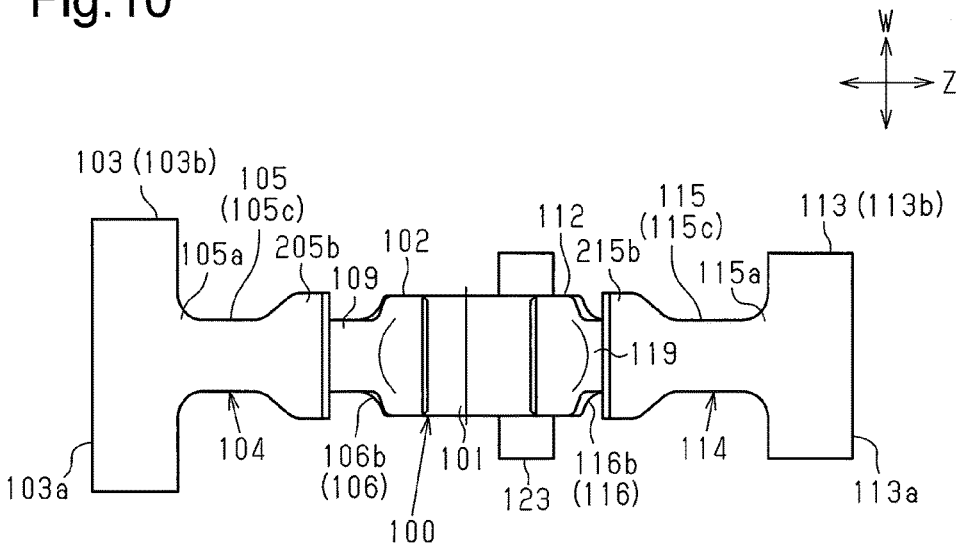
FIG. 10 is a plan view showing a double-headed piston of another example.
Figure 11:
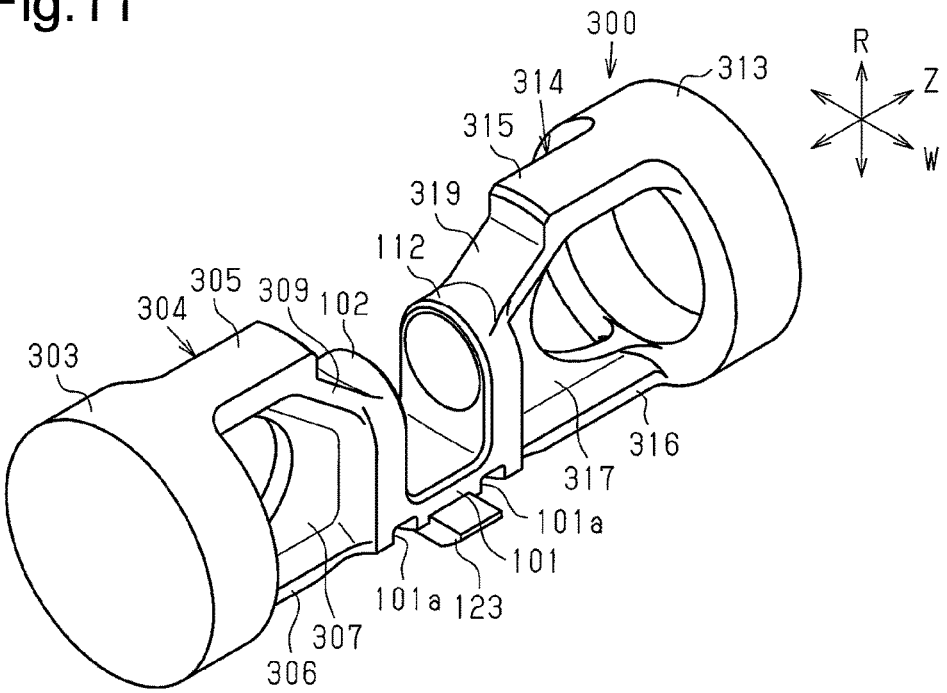
FIG. 11 is a perspective view showing a double-headed piston of a further example.

As shown in FIG. 10, the inner portions 105 and 115 respectively include distal portions 205*b* and 215*b*. The distal portions 205*b* and 215*b* may be wider than the middle parts of the inner portions 105 and 115. Further, when the width W1 of the neck 101 is larger than the shoe width W2, the distal portions of the inner portions 105 and 115 may have a larger width than the shoe width W2 as long as the width is less than or equal to the width W1 of the neck 101. Even in this case, the parts of the inner portions 105 and 115 closer to the heads 103 and 113 are the narrow portions 105*c* and 115*c* and thus the coupling portions 104 and 114 are deformable in the widthwise direction W. In addition, at least one of the two inner portions 105 and 115 may have a narrow portion.

When the width W1 of the neck 101 is larger than the shoe width W2, the outer portions 106 and 116 may be at least partially wider than the shoe width W2 as long as the outer portions 106 and 116 each have a width that is less than or equal to the width W1 of the neck 101. The two ends of the outer portions 106 and 116 do not have to be inversely-tapered and may have, for example, a fixed width. Alternatively, the outer portions 106 and 116 may be thicker or thinner than the inner portions 105 and 115.

The basal portions 105*a* and 115*a* of the inner portions 105 and 115 do not have to be inversely-tapered. Instead, the basal portions 105*a* and 115*a* may have, for example, a fixed width.

A symmetrical double-headed piston 300 as shown in FIGS. 11 to 14 may be used. The double-headed piston 300 includes the neck 101, the two shoe holders 102 and 112, heads 303 and 313, coupling portions 304 and 314, and ribs 309 and 319. These elements basically have the same structure as the corresponding elements in the above double-headed piston 100. However, the two heads 303 and 313 have the same diameter, and the two coupling portions 304 and 314 have the same length in the axial direction of the double-headed piston 300.

Figure 12:
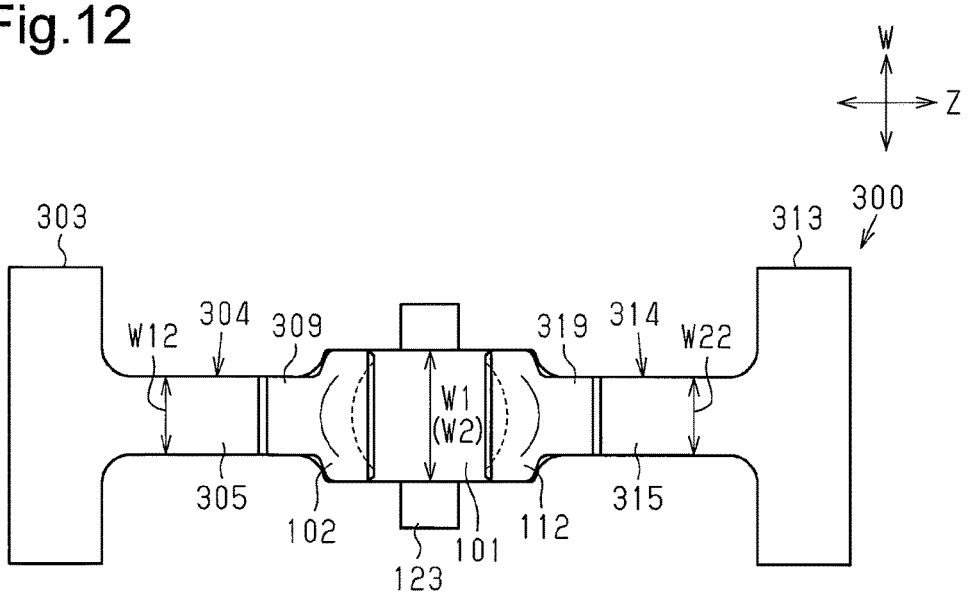
FIG. 12 is a plan view of the double-headed piston shown in FIG. 11.
Figure 13:
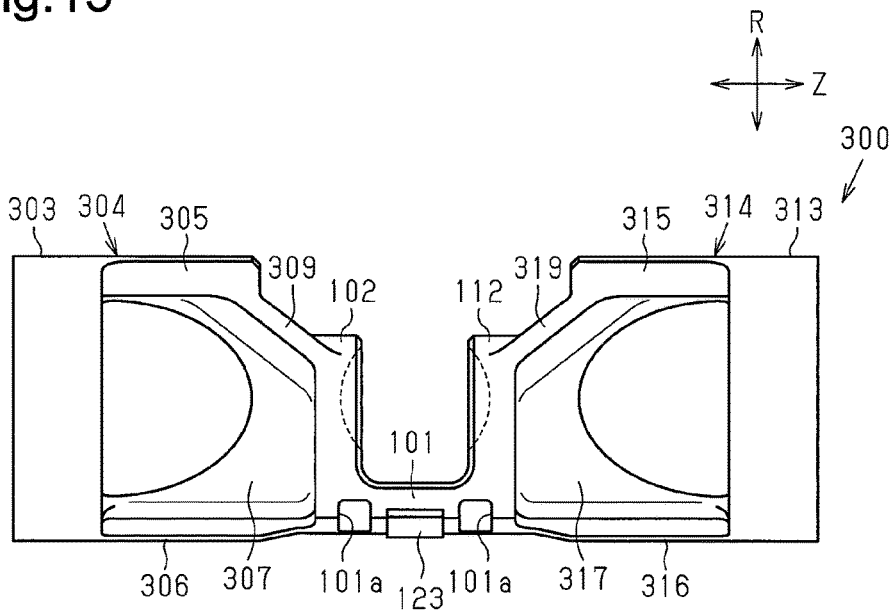
FIG. 13 is a side view of the double-headed piston shown in FIG. 11.

The coupling portions 304 and 314 respectively include inner portions 305 and 315, outer portions 306 and 316, and plates 307 and 317. As shown in FIG. 12, the widths of the two coupling portions 304 and 314 are less than or equal to the width W1 of the neck 101, and the widths W12 and W22 of the inner portions 305 and 315 are less than or equal to the shoe width W2.

Figure 14:
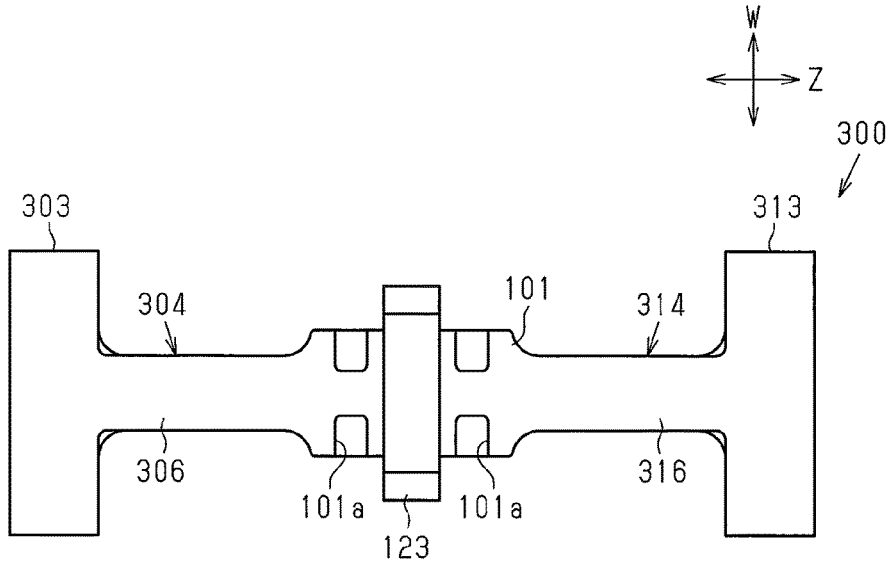
FIG. 14 is a rear view of the double-headed piston shown in FIG. 11.

The rotation stopper 123 is arranged at the middle portion of the outer surface of the neck 101 in the axial direction of the double-headed piston 300. As shown in FIG. 14, the neck recesses 101*a* are arranged at opposite sides of the rotation stopper 123 in the outer surface of the neck 101.

In the embodiment, the first coupling portion 104 is, in the axial direction of the double-headed piston 100, longer than the second coupling portion 114. Instead, the two coupling portions 304 and 314 may have the same length. Alternatively, the second coupling portion may be longer than the first coupling portion.

Further, as described above, the first head may have the same size as the second head. Alternatively, the second head may be larger than the first head.

It is preferred that the cylinder bores 91 and 92 have the same diameter when the symmetrical double-headed piston 300 is used as described above.

The ribs 109 and 119 are not limited to any specific structure as long as the ribs 109 and 119 do not interfere with the swash plate 50. For example, the ribs 109 and 119 may be L-shaped or inversely L-shaped as viewed in the widthwise direction W.

The neck 101 and the coupling portions 104 and 114 are not limited to the forms illustrated in the embodiment. Further, one of the two coupling portions 104 and 114 may have a width that is less than or equal to the width W1 of the neck 101, and the other one may have a larger width than the width W1 of the neck 101. That is, at least one of the two coupling portions 104 and 114 may have a width that is less than or equal to the width W1 of the neck 101 and may be deformable in the widthwise direction W.

The heads 103 and 113 may be cylindrical.

The neck recess 101*a* may have any shape. Further, the neck recess 101*a* may be omitted.

The through holes 107*a* and 117*a* are not limited to any specific shape. Further, at least one of the through holes 107*a* and 117*a* may be omitted, and at least one of the plates 107 and 117 may be omitted.

The rotation stopper 123 may be located closer to the first shoe holder 102 than the neck recesses 101*a*. Alternatively, the rotation stopper 123 may be located closer to both of the first shoe holder 102 and the second shoe holder 112 than the neck recesses 101*a*. Further, the rotation stopper 123 may be omitted.

The actuator 70 may have any specific structure as long as the actuator 70 is capable of changing the inclination angle of the swash plate 50. In the same manner, the link mechanism 60 may have any specific structure as long as the link mechanism 60 is capable of transmitting power from the rotation shaft 20 to the swash plate 50.

At least one of the first projection 81 and the second projection 82 may be omitted.

The number of the cylinder bores 91 and 92 and the number of the double-headed piston 100 are not limited to those of the embodiment and may each be, for example, one.

The lengths X11 and X21 of the inner portions 105 and 115 may be less than or equal to the lengths X12 and X22 of the ribs 109 and 119.

The widths W12 and W22 of the two inner portions 105 and 115 are basically the same. Instead, the two inner portions 105 and 115 may have different widths. In the same manner, the widths W11 and W21 of the two outer portions 106 are basically the same. Instead, the two outer portions 106 and 116 may have different widths. Further, the width W12 of the first inner portion 105 and the width W21 of the second outer portion 116 may be the same or different. The same applies to the width W12 of the first inner portion 105 and the width W21 of the second outer portion 116.

The inner portions 105 and 115 may be thicker or thinner than the outer portions 106 and 116. Alternatively, the inner portions 105 and 115 may have the same thickness as the outer portions 106 and 116.

The widths of the two coupling portions 104 and 114 may be the same as the width W1 of the neck 101.

At least one of the first narrow portion 105*c* and the second narrow portion 115*c* may have the same width as the shoe width W2.

At least one of each of the inner portions 105 and 115 and each of the outer portions 106 and 116 may be slightly inclined with respect to the axial direction of the double-headed piston 100.

The compressor 10 of the embodiment is of a variable displacement type. Instead, the compressor 10 may be of a fixed displacement type in which the inclination angle of the swash plate 50 is fixed.

The fluid subject to compression by the compressor 10 is not limited to refrigerant and may be, for example, air.

The compressor 10 does not have to be installed in a vehicle.

The above embodiment may be combined with each of the modified examples.

Therefore, the present examples and embodiments are to be considered as illustrative and not restrictive and the invention is not to be limited to the details given herein, but may be modified within the scope and equivalence of the appended claims.

The invention claimed is:

1. A double-headed piston type swash plate compressor comprising:

a rotation shaft extending in an axial direction and a radial direction;

a housing that accommodates the rotation shaft;

a swash plate that rotates when the rotation shaft rotates;

two cylinder bores opposed to each other in the axial direction of the rotation shaft and located in the housing at an outer side of the rotation shaft in the radial direction;

a double-headed piston that reciprocates in the two cylinder bores; and two shoes that couple the double-headed piston to the swash plate, wherein the two cylinder bores and the double-headed piston define two compression chambers, rotation of the swash plate reciprocates the double-headed piston in the two cylinder bores and compresses fluid in each of the compression chambers, the double-headed piston includes:

two shoe holders that hold the two shoes, wherein the two shoe holders are opposed to each other in an axial direction of the double-headed piston;

a neck that couples the two shoe holders, wherein the neck is located at an outer circumferential side of the swash plate;

two heads respectively located at two ends of the double-headed piston in the axial direction of the double-headed piston, wherein the two heads are respectively located in the two cylinder bores with a gap formed between each of the two heads and a wall surface of the corresponding one of the two cylinder bores; and two coupling portions that couple the two shoe holders and the two heads, respectively, each of the coupling portions includes:

an outer portion extending in the axial direction of the double-headed piston; and an inner portion located at an inner side of the outer portion in the radial direction, wherein the inner portion is extended in the axial direction of the double-headed piston and opposed to the outer portion in the radial direction, when referring to a direction orthogonal to both of an opposing direction of the inner portion and the outer portion and the axial direction of the double-headed piston as a widthwise direction, the neck is larger in the widthwise direction than in the opposing direction so that the neck is deformable in the opposing direction when the swash plate applies load to the double-headed piston, each of the two coupling portions has a width that is less than or equal to a width of the neck, the inner portion includes a narrow portion having a width that is less than or equal to a width of each of the shoe holders, the narrow portion is at least partially located closer to the head than the shoe holder in the inner portion, and the two coupling portions are deformable in the widthwise direction when the swash plate applies load to the double-headed piston.

2. The double-headed piston type swash plate compressor according to claim 1, wherein each of the two coupling portions includes a plate that connects the inner portion and the outer portion, the plate has a thickness in the widthwise direction, and the thickness of the plate is less than a width of each of the inner portion and the outer portion.

3. The double-headed piston type swash plate compressor according to claim 2, wherein the plate includes a through hole that extends through the plate in the widthwise direction.

4. The double-headed piston type swash plate compressor according to claim 1, wherein the inner portion is extended in the axial direction of the double-headed piston from an inner side of the corresponding head in the radial direction and located at an inner side of the corresponding shoe holder in the radial direction, the inner portion includes an end near the corresponding shoe holder, wherein the end is located between the shoe holder and the head as viewed in the opposing direction, and each of the two coupling portions includes a rib that connects the end of the inner portion and the shoe holder so that a space is defined beside the end of the inner portion as viewed in the widthwise direction.

5. The double-headed piston type swash plate compressor according to claim 1, wherein the neck includes an outer surface that includes a recess.

6. The double-headed piston type swash plate compressor according to claim 1, further comprising an actuator that changes an inclination angle of the swash plate, wherein the actuator includes:

a movable body that is movable in the axial direction of the rotation shaft; and a partition that defines a control chamber in cooperation with the movable body, and the actuator is operable to change an inclination angle of the swash plate when the movable body is moved in accordance with pressure of the control chamber.

7. The double-headed piston type swash plate compressor according to claim 6, wherein the two heads include a first head and a second head, and the second head has a smaller diameter than a diameter of the first head.

8. The double-headed piston type swash plate compressor according to claim 7, wherein the neck includes a rotation stopper that restricts rotation of the double-headed piston in the two cylinder bores, and the rotation stopper of the neck is located closer to the second head than the first head.

* * * * *